US006492818B1

(12) United States Patent
Downs

(10) Patent No.: US 6,492,818 B1
(45) Date of Patent: Dec. 10, 2002

(54) APPARATUS AND METHOD FOR DETERMINING COMPONENT FAULT CONDITIONS AS A FUNCTION OF PRIMARY COIL VOLTAGE IN A CAPACITIVE DISCHARGE IGNITION SYSTEM

(75) Inventor: Robert A. Downs, Greenwood, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 09/707,125

(22) Filed: Nov. 6, 2000

(51) Int. Cl.[7] ..... F02P 17/12
(52) U.S. Cl. ..... 324/382; 324/388; 324/392
(58) Field of Search ..... 324/382, 391, 324/392, 399, 388, 379, 380; 340/662; 701/114

(56) References Cited

U.S. PATENT DOCUMENTS

| | | | | | |
|---|---|---|---|---|---|
| 3,870,027 | A | * | 3/1975 | Jacobs | 123/598 |
| 4,128,005 | A | | 12/1978 | Arnston et al. | 73/117.3 |
| 4,366,794 | A | | 1/1983 | Hachiga et al. | 123/479 |
| 4,449,100 | A | | 5/1984 | Johnson et al. | 324/378 |
| 4,913,123 | A | | 4/1990 | DeBiasi et al. | 123/609 |
| 5,208,540 | A | * | 5/1993 | Hoeflich | 324/388 |
| 5,325,835 | A | | 7/1994 | Kimata et al. | 123/475 |
| 5,623,209 | A | | 4/1997 | Lepley et al. | 324/382 |
| 5,672,972 | A | | 9/1997 | McCoy et al. | 324/393 |
| 5,790,039 | A | * | 8/1998 | Palara et al. | 340/662 |
| 6,006,156 | A | * | 12/1999 | Tozzi | 701/114 |
| 6,275,041 | B1 | * | 2/2000 | Okamura et al. | 324/380 |
| 6,085,144 | A | | 7/2000 | Tozzi | 701/114 |

* cited by examiner

*Primary Examiner*—N. Le
*Assistant Examiner*—Anjan K. Deb
(74) *Attorney, Agent, or Firm*—Barnes & Thornburg

(57) ABSTRACT

An apparatus for determining component fault conditions associated with a capacitive discharge ignition system for an internal combustion engine includes a number of AC coupling circuits connected to a spark detection circuit, wherein the combination is responsive to a corresponding number of primary coil voltage signals to produce digital pulses indicative of reflected spark events from the various secondary coils to the respective primary coils of the ignition system. A number of level shifting circuits are also included and provide a pulse width circuit with a corresponding number of level-shifted primary coil voltage signals. A pulse width circuit is responsive to the number of level-shifted primary coil voltage signals to produce appropriate digital pulses timed to match the non-zero voltage times of the various primary coil voltage signals. A signal processing circuit is responsive to the digital signals produced by the spark detection circuit and the pulse width circuit to determine spark breakdown voltage, shorted ignition coils, worn ignition plugs, shorted ignition plugs, ignition control module faults and external arcing conditions. These faults are communicated to a service technician via a display and/or by logging such faults in memory.

53 Claims, 11 Drawing Sheets

FROM FIG. 10A

APPARATUS AND METHOD FOR DETERMINING COMPONENT FAULT CONDITIONS AS A FUNCTION OF PRIMARY COIL VOLTAGE IN A CAPACITIVE DISCHARGE IGNITION SYSTEM

FIELD OF THE INVENTION

The present invention relates generally to capacitive discharge ignition systems for internal combustion engines, and more specifically to techniques for determining component fault conditions as a function of primary coil voltage in such systems.

BACKGROUND OF THE INVENTION

Capacitive discharge ignition systems for internal combustion engines are known and commonly implemented in a variety of applications. Such systems typically include an energy storage mechanism, e.g., storage capacitor, coupled to a charging source and to the primary coil of an internal combustion engine ignition coil. An ignition plug is connected across a secondary coil coupled to the primary coil, and discharge of the capacitor through the primary coil induces a high voltage across the secondary coil that ultimately establishes an arc across the spark gap of the ignition plug.

An example of a known capacitive discharge ignition system 10 of the type just described is shown in FIG. 1 and includes a battery 12 or other source of DC potential electrically connected to a DC-DC converter 14. An output of the converter 14 is connected to one end of a capacitor 16 and to one end of a primary coil 18 of an ignition coil 20. The opposite end of the primary coil 18 is connected to a switch 22 that is typically electrically controlled by a control circuit 24 via signal path 26. The opposite ends of the switch 22 and the capacitor 16 are connected to ground potential. A secondary coil 28 coupled to the primary coil 18 is connected across the spark gap of an ignition plug 30 to complete the circuit.

In operation, the DC-DC converter 14 amplifies the voltage supplied by the battery 12 (typically 12 volts DC) to several hundred (e.g., approximately 400) volts to quickly charge the capacitor 16 while the switch 22 is open as shown in FIG. 1. Referring to FIGS. 2 and 3, the control circuit 24 is operable to initiate a spark event by closing switch 22 at time $T_0$. The closing of switch 22 discharges the previously charged capacitor 16 through the primary coil 18, thereby causing the primary coil voltage (PV) 32 to increase sharply (and negatively) from V3 to V4. The electrical pulse provided by capacitor 16 is amplified by the turn ratio of the secondary coil 28 relative to the primary coil 18 (typically on the order of 100:1), thereby causing the secondary coil voltage (SV) 34 to rapidly increase (also negatively) from voltage level V1 (e.g., approximately zero volts). As the secondary voltage SV resultantly increases over time, a voltage level V2 (on the order of 30 kV) will eventually be reached (at time $T_1$) at which the spark gap of ignition plug 30 breaks down (ionizes) and becomes electrically conductive. When this occurs, an electrical arc is established across the spark gap and the secondary coil voltage SV drops sharply to its approximately its pre-discharge voltage (e.g., approximately zero volts). The capacitor 16 continues to discharge until its charge is substantially depleted (at time $T_2$), and the control circuit 24 thereafter opens switch 22 to allow charging of the capacitor 16 via converter 14 for the next spark event.

In modern capacitive discharge ignition systems, each cylinder of the engine typically is provided with a dedicated ignition coil 20 and associated switching circuitry. However, while such complexity allows for excellent control over ignition system operation, it also invites a plethora of potential fault and failure conditions associated with one or more of the various ignition system components. Possible faults typically range in severity from degraded system performance to system and/or engine damage, and it is therefore desirable to provide for fault diagnosis capability. Unfortunately, conventional fault/failure diagnostic techniques for capacitive discharge ignition systems are prohibitively expensive and/or are generally ineffective in their essential purpose.

What is therefore needed is a diagnostic approach for capacitive discharge ignition systems that does not suffer from the drawbacks of known diagnostic systems while also providing for detection of a wide range of component faults, failures and/or degradation.

SUMMARY OF THE INVENTION

The foregoing shortcomings of the prior art are addressed by the present invention. In accordance with one aspect of the present invention, a method of diagnosing ignition system fault conditions in a capacitive discharge ignition system for an internal combustion engine comprises the steps of measuring a first time difference between an onset of capacitive discharge and occurrence of a reflected spark event in a primary coil voltage of a capacitive discharge ignition system for an internal combustion engine, and determining at least one ignition system fault condition as a function of the first time difference.

In accordance with another aspect of the present invention, an apparatus for determining component fault conditions as a function of primary coil voltage in a capacitive discharge ignition system comprises an ignition coil including a primary coil electrically connected to a capacitor and a secondary coil electrically connected to an ignition plug, means for controllably discharging the capacitor through the primary coil, a spark detection circuit responsive to a primary voltage across the primary coil to compute a first time difference between a beginning of discharge of the capacitor and occurrence of a reflected spark event in the primary voltage, and a processing circuit responsive to the first time difference to determine at least one ignition system fault condition.

One object of the present invention is to provide an apparatus and method for diagnosing fault conditions in a capacitive discharge ignition system based strictly on an analysis of the primary coil voltage.

Another object of the present invention is to provide such an apparatus an method for diagnosing a number of ignition system component fault conditions including, but not limited to, ignition control module (ICM) faults, electrically shorted ignition plugs, worn ignition plugs, electrically shorted ignition coils and external arcing faults.

These and other objects of the present invention will become more apparent from the following description of the preferred embodiment.

DESCRIPTION OF THE PREFERRED EMBODIMENT

Figure 1:
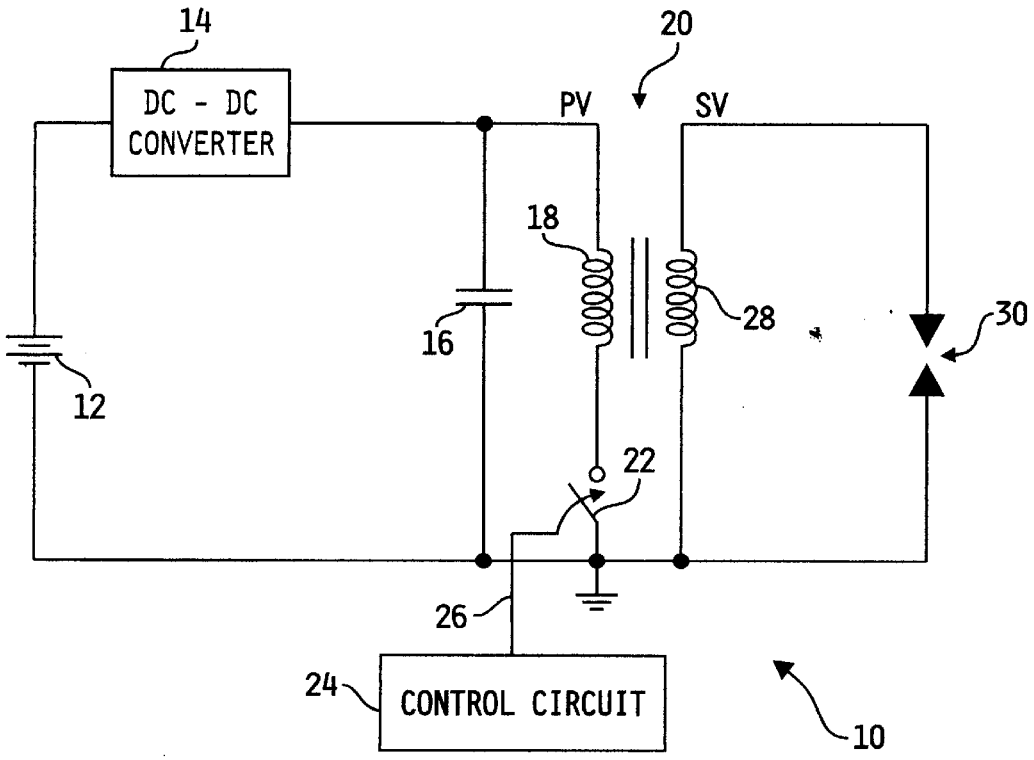
FIG. 1 (PRIOR ART)
FIG. 1 is a diagrammatic illustration of a known capacitive discharge ignition system for an internal combustion engine.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

Figure 2:
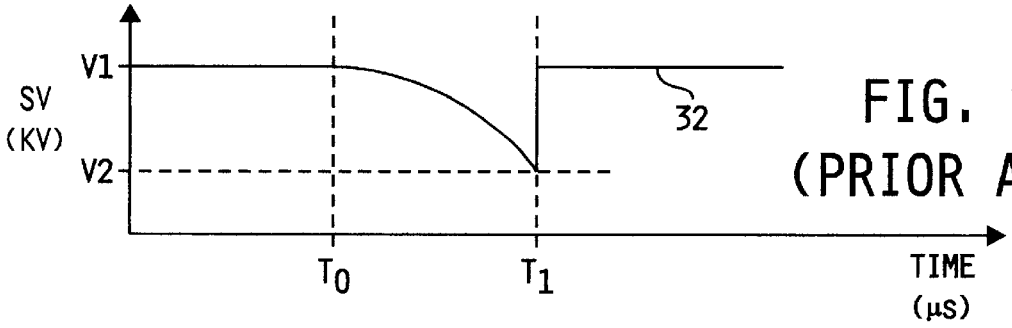
FIG. 2 (PRIOR ART)
FIG. 2 is a plot of secondary coil voltage vs. time illustrating operation of the known ignition system of FIG. 1.
Figure 3:
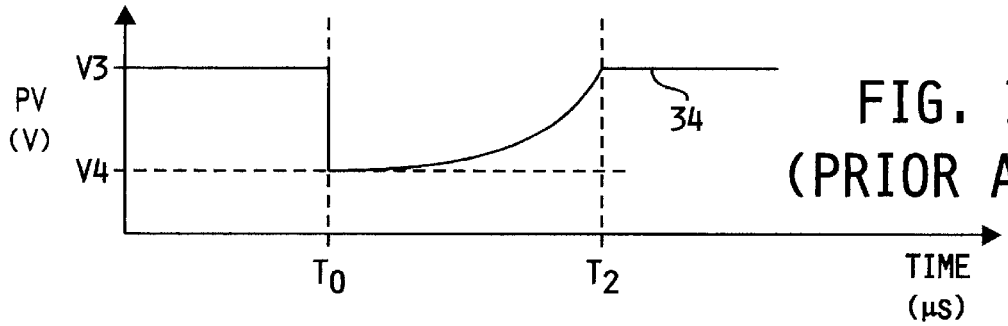
FIG. 3 (PRIOR ART)
FIG. 3 is a plot of primary coil voltage vs. time illustrating operation of the known ignition system of FIG. 1.
Figure 4:
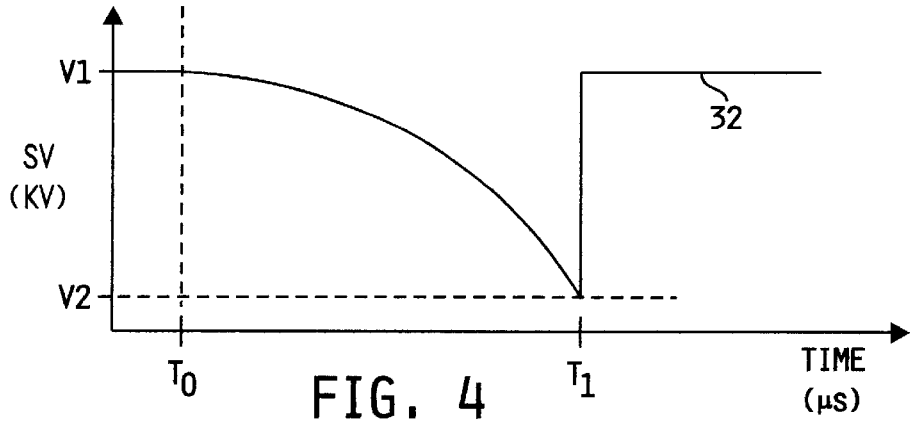
FIG. 4 is a magnified plot of secondary coil voltage vs. time for the capacitive discharge ignition system of FIG. 1.
Figure 5:
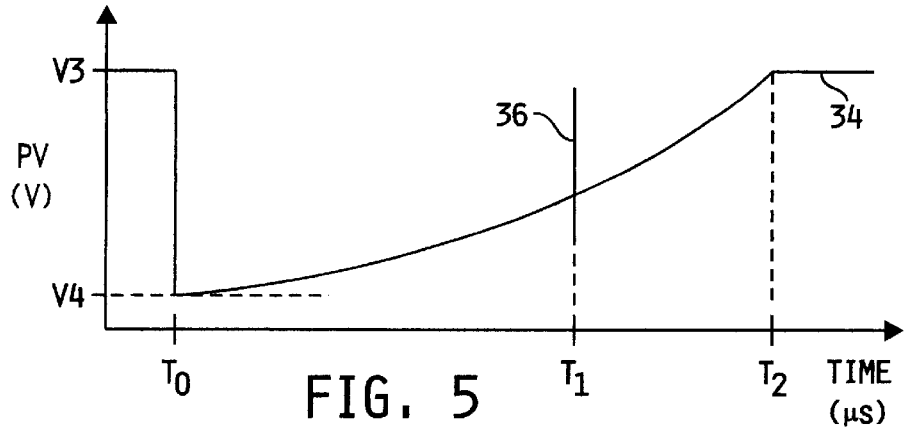
FIG. 5 is a magnified plot of primary coil voltage vs. time for the capacitive discharge ignition system of FIG. 1 illustrating a reflected spark event in the primary coil voltage signal.

Referring now to FIGS. 4 and 5, magnified plots of the primary coil voltage 32 and secondary coil voltage 34 waveforms, similar to those of FIGS. 2 and 3, are shown. In accordance with the present invention, it has been observed that the rapid decrease of the secondary coil voltage at time $T_1$ reflects a high frequency voltage spike 36 in the primary coil voltage waveform 34. While reflected spark events of this type are commonly observed in inductive ignition systems, such voltage spikes are typically much lower in frequency in these systems and consequently readily observable. By contrast, the reflected spark event 36 in capacitive ignition systems, as illustrated in FIG. 5, are comparatively much shorter in duration and accordingly very difficult to detect. Heretofore, reflected spark events 36 in capacitive discharge ignition systems have therefore typically gone unnoticed and/or ignored. A primary aim of the subject invention is to process the primary coil voltage waveform 34 to determine useful diagnostic information relating to the health and/or operating condition of various ignition system components.

Figure 6:
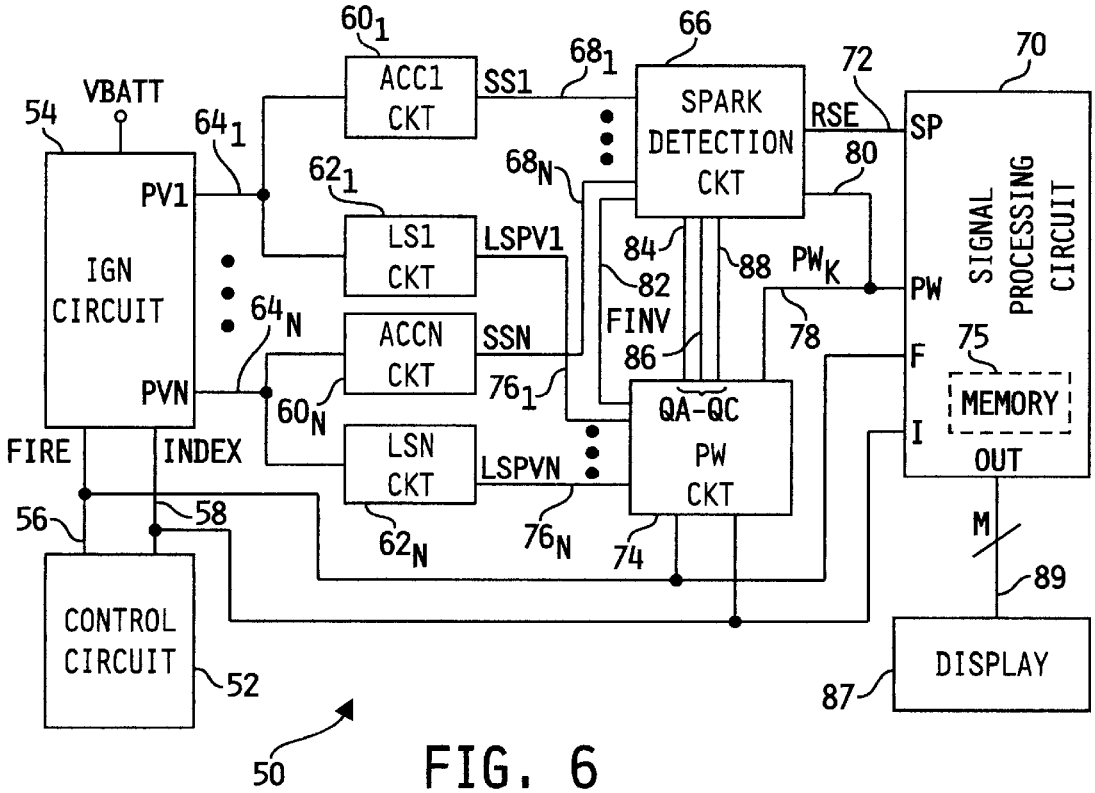
FIG. 6 is a diagrammatic illustration of a capacitive discharge ignition system including circuitry for determining system component fault conditions as a function of the primary coil voltage, in accordance with one preferred embodiment of the present invention.

Referring now to FIG. 6, one preferred embodiment of a capacitive discharge ignition system 50, in accordance with the present invention, is shown. As will be described in greater detail hereinafter, system 50 includes circuitry operable to process a number, N, of primary coil voltages (PV) and determine therefrom various characteristic ignition system faults and/or failures. In general, the system 50 illustrated in FIG. 6 is designed for use with a capacitive discharge ignition system having individual (dedicated) ignition circuits (e.g., ignition coils 20, switches 22 and ignition plugs 30) for each of the engine cylinders, wherein N corresponds to the number of cylinders in the given application. For the purpose of describing the present invention, specific examples may be provided hereinafter describing a six-cylinder application (e.g., N=6), although it should be understood that the concepts of the present invention are equally applicable to internal combustion engines having any number of cylinders. It is to be understood that such specific illustrations and descriptions are provided only by way of example, and should therefore not be considered to be limiting.

Capacitive discharge ignition system 50 includes a control circuit 52 of known construction and producing conventional FIRE and INDEX signals on signal paths 56 and 58 respectively. The FIRE signal is used to control switches 22 to manage the charging and discharging times of capacitor 16 (and therefore initiate spark events), and the INDEX signal is used to manage a desired firing sequence of the various N cylinders each as is known in the art. Control circuit 52 is preferably a microprocessor-based control computer such as a so-called engine or electronic control module (ECM), engine or electronic control unit (ECU) or the like, although the present invention contemplates that control circuit 52 may alternatively be, or include, any known circuit operable to produce appropriately timed FIRE and INDEX signals. In any case the FIRE and INDEX signals are provided via signal paths 56 and 58 to an ignition (IGN) circuit 54 connected to a suitable voltage supply VBATT. In one preferred embodiment, IGN circuit 54 includes all of the coil and spark-related circuits and components, such as that shown in FIG. 1, for each of the N cylinders. IGN circuit 54 is accordingly operable to produce a number, N, of primary coil voltage signals PV1–PVN, wherein N may be any positive integer, on corresponding signal paths $\mathbf{64}_1$–$\mathbf{64}_N$.

Each of the N signals paths $\mathbf{64}_1$–$\mathbf{64}_N$ is electrically connected to a corresponding AC coupling circuit $\mathbf{60}_1$–$\mathbf{60}_N$ (ACC1–ACCN) and to a corresponding level shifting circuit $\mathbf{62}_1$–$\mathbf{62}_N$ (LS1–LSN). Spark signal outputs SS1–SSN are produced by the corresponding AC coupling circuits $\mathbf{60}_1$–$\mathbf{60}_N$ on corresponding signal paths $\mathbf{68}_1$–$\mathbf{68}_N$, and are provided as inputs to a spark detection circuit 66. Circuit 66 defines an output electrically connected to a spark signal input SP of a signal processing circuit 70 via signal path 72. Circuit 66 is generally responsive to the spark signals SS1–SSN at the various inputs thereof to produce a reflected spark event signal RSE on signal path 72, wherein RSE is preferably a square wave signal defining pulse edges coincident in time with the occurrence of the reflected spark events in the various primary coil voltages PV1–PVN.

Level-shifted primary voltage signal outputs LSPV1–LSPVN are produced by the corresponding level shifting circuits $62_1$–$62_N$ on corresponding signal paths $76_1$–$76_N$, and are provided as inputs to a pulse width (PW) circuit 74. PW circuit 74 includes two additional inputs receiving the FIRE and INDEX signals respectively, and defines a number of outputs connected to the spark detection circuit 66. For example, PW circuit 74 provides a number of address signals to spark detection circuit 66, and in the embodiment illustrated in FIG. 6, PW circuit 74 provides three such address signals QA, QB and QC to spark detection circuit 66 via signal paths 84, 86 and 88 respectively. In general, the number of address signals produced by PW circuit 74 will be dictated by the number N of cylinders in the application, wherein a sufficient number of address lines must typically be made available to allow binary counting of the N cylinders. Thus, for example, in a six-cylinder application, as illustrated in FIG. 6, three such address lines 84, 86 and 88 must be provided. PW circuit 74 is also operable to invert the FIRE signal and provide an inverted FIRE signal FINV to spark detection circuit 66 via signal path 82. The spark detection circuit 66 is responsive to the FINV signal to delay detection of the reflected spark events for each of the various primary voltage signals PVk until after the various PVk signals have stepped down from voltage V3 to V4 (see FIG. 5) so as not to interpret such a step as a reflected spark event, as will be described in greater detail hereinafter.

The PW circuit 74 defines an output electrically connected to a pulse width (PW) input of signal processing circuit 70. PW circuit 74 is responsive to the level-shifted primary voltage signals LSPV1–LSPVN and to the FIRE and INDEX signals to produce a single pulse width signal PWk on signal path 78 for each FIRE pulse, wherein PWk generally defines a width or duration substantially equal to the width or duration of the discharge duration of the IGN circuit capacitor for the $k^{th}$ cylinder. Thus, through decoding of the FIRE and INDEX signals, PW circuit 74 is operable to produce on signal path 78 a square wave pulse for each cylinder spark event having a leading edge coincident in time with the onset of capacitor discharge for that cylinder and a trailing edge coincident in time with the end of capacitor discharge for that cylinder. Signal path 78 is connected to another input of spark detection circuit 66 via signal path 80, wherein the spark detection circuit is responsive to each $PW_k$ signal to terminate the corresponding RSE pulse as will be described in greater detail hereinafter.

Signal processing circuit 70 includes two additional inputs F and I electrically connected to signal paths 56 and 58 respectively and receiving the FIRE and INDEX signals thereat. Signal processing circuit is preferably a known microprocessor-based control circuit and includes a memory 75 for storing diagnostic data as well as storing one or more software algorithms executable by signal processing circuit 70 to carry out the concepts of the present invention. A display unit 87 of known construction is connected to an output port OUT of signal processing circuit 70 via a number, M, of signal paths 89 wherein M may be any positive integer. In operation, the signal processing circuit 70 is operable to display diagnostic data relating to system 50 on display unit 87.

Figure 7:
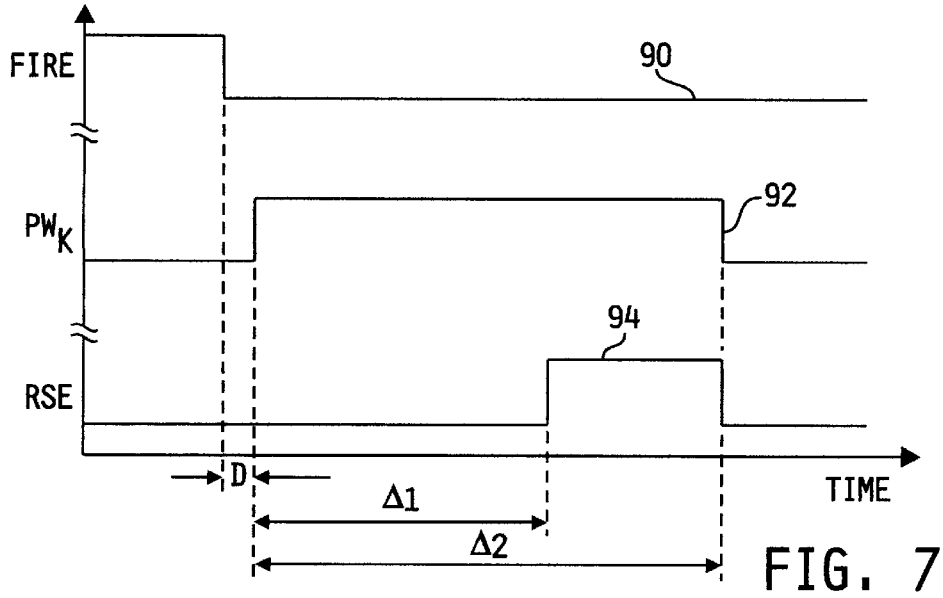
FIG. 7 is a signal timing diagram illustrating operation of the system illustrated in FIG. 6, in accordance with the present invention.

Referring now to FIG. 7, an overview of the normal operation of system 50, as it relates to a single cylinder of an internal combustion engine, will now be described. It is to be understood, however, that system 50 is operable as illustrated with respect to FIG. 7 to all engine cylinders. For any $k^{th}$ cylinder, e.g., cylinder 1, control circuit 52 is operable to produce a suitably timed FIRE signal 90 and an appropriate INDEX signal (not shown in FIG. 7) identifying the $k^{th}$ cylinder as the cylinder now being fired. The IGN circuit 54 is responsive to the FIRE and INDEX signals to initiate a capacitive discharge event for the $k^{th}$ cylinder by closing an appropriate one of the switches 22 (see FIG. 1). Under normal operating conditions, the level shifting circuit LSk $62_k$ is responsive to the corresponding primary coil voltage PVk to shift this voltage typically spread over several hundred volts to an identically shaped signal spread over only a few (e.g., 5) volts. The PW circuit 74 is responsive to the resulting level-shifted LSPVk signal to produce a square wave pulse width signal $PW_k$ 92 having a leading edge coincident in time with the onset of capacitive discharge and a trailing edge coincident in time with the end of capacitive discharge. The $PW_k$ signal is provided to the PW input of the signal processing circuit 70 via signal path 78. Typically, there exists a delay D (e.g., 10 microseconds or less) between the falling edge of the FIRE signal 90 and the rising edge of the $PW_k$ signal 92, as illustrated in FIG.7. The total duration or time difference $\Delta 2$ of the $PW_k$ signal 92, as measured from the leading to the trailing edge thereof is, in one embodiment, typically between 30 and 105 microseconds.

The spark detection circuit 66 is responsive to the reflected spark events in the primary coil voltages PVk (i.e., responsive to the various SSk signals) to produce a square wave pulse RSE having leading edges coincident in time with the occurrence of the various reflected spark events in the primary coil voltages PVk relative to the onset of capacitive discharge as measured from the rising edge of the $PW_k$ signals. The total duration or time difference $\Delta 1$ between the leading edge of the $PW_k$ signal 92 and the leading edge of the RSE signal 94 is, in one embodiment, typically between 10 and 105 microseconds. The signal processing circuit 70 is responsive to the thus digitized primary coil signals PV1–PVN to determine therefrom certain diagnostic information relating to the health and/or operational status of one or more of the components of system 50 as will be described in greater detail hereinafter with respect to FIGS. 13A–15B.

Figure 8:
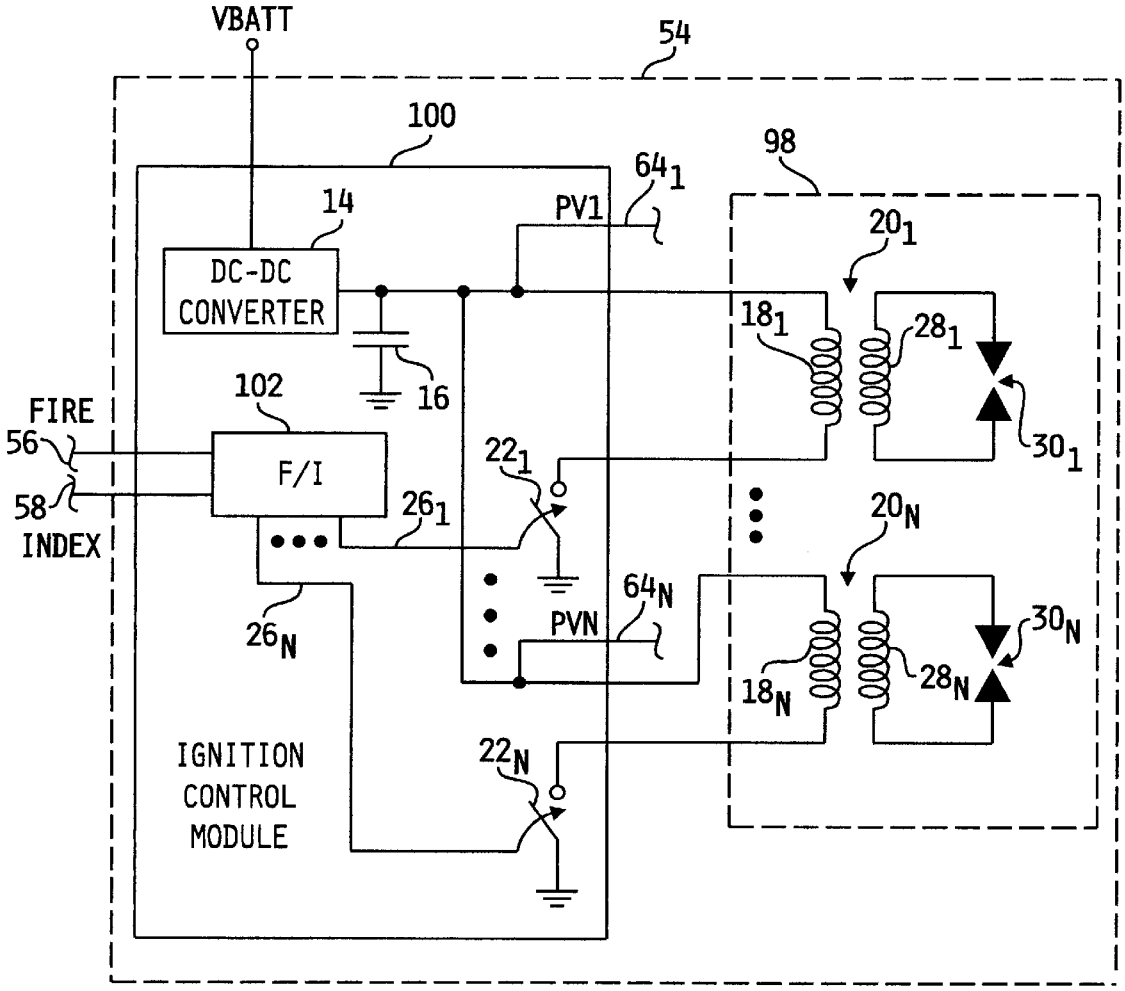
FIG. 8 is a diagrammatic illustration of one preferred embodiment of the ignition (IGN) circuit of the system shown in FIG. 6, in accordance with the present invention.

Referring now to FIG. 8, one preferred embodiment of the IGN circuit 54, in accordance with the present invention, is shown. It will be noted that IGN circuit 54 includes many of the components illustrated in FIG. 1 for each cylinder of the internal combustion engine 98. Like numbers are therefore used to identify like components. For example, each cylinder of the engine 98 includes an ignition coil ($20_1$–$20_N$) and ignition plug ($30_1$–$30_N$) The IGN circuit 54 further includes an ignition control module (ICM) 100 including the remaining circuit components of the ignition circuit. For example, for the N ignition coils ($20_1$–$20_N$) to be controlled, ICM 100 preferably includes a single DC-DC converter 14 connected to a corresponding capacitor 16 and to the various primary coils ($18_1$–$18_N$) via the various signal paths $64_1$–$64_N$ carrying the primary coil voltages PV1–PVN. The opposite ends of the N primary coils ($18_1$–$18_N$) are connected to corresponding switches ($22_1$–$22_N$) that are each connected to a fire/index (F/I) circuit 102 by appropriate control lines $26_1$–$26_N$. F/I circuit 102 is of known construction and is responsive to the FIRE and INDEX signals provided thereto via signal paths 56 and 58 respectively to control the timing and sequencing of the various switches $22_1$–$22_N$ as is known in the art. In the embodiment shown in FIG. 8, including the coil control circuitry 14, 16 and $\mathbf{22}_x$ within a single ignition control module ICM is advantageous because one of the fault codes defined by the present invention is an ICM hardware fault or failure as will be described in greater detail hereinafter. By separating this circuitry from the coils $\mathbf{20}_1$–$\mathbf{20}_N$ and plugs $\mathbf{30}_1$–$\mathbf{30}_N$, failures or faults having to do with one or more of these circuit components therein can easily be distinguished from faults or failures associated with the ICM 100.

Figures 9, 10A:
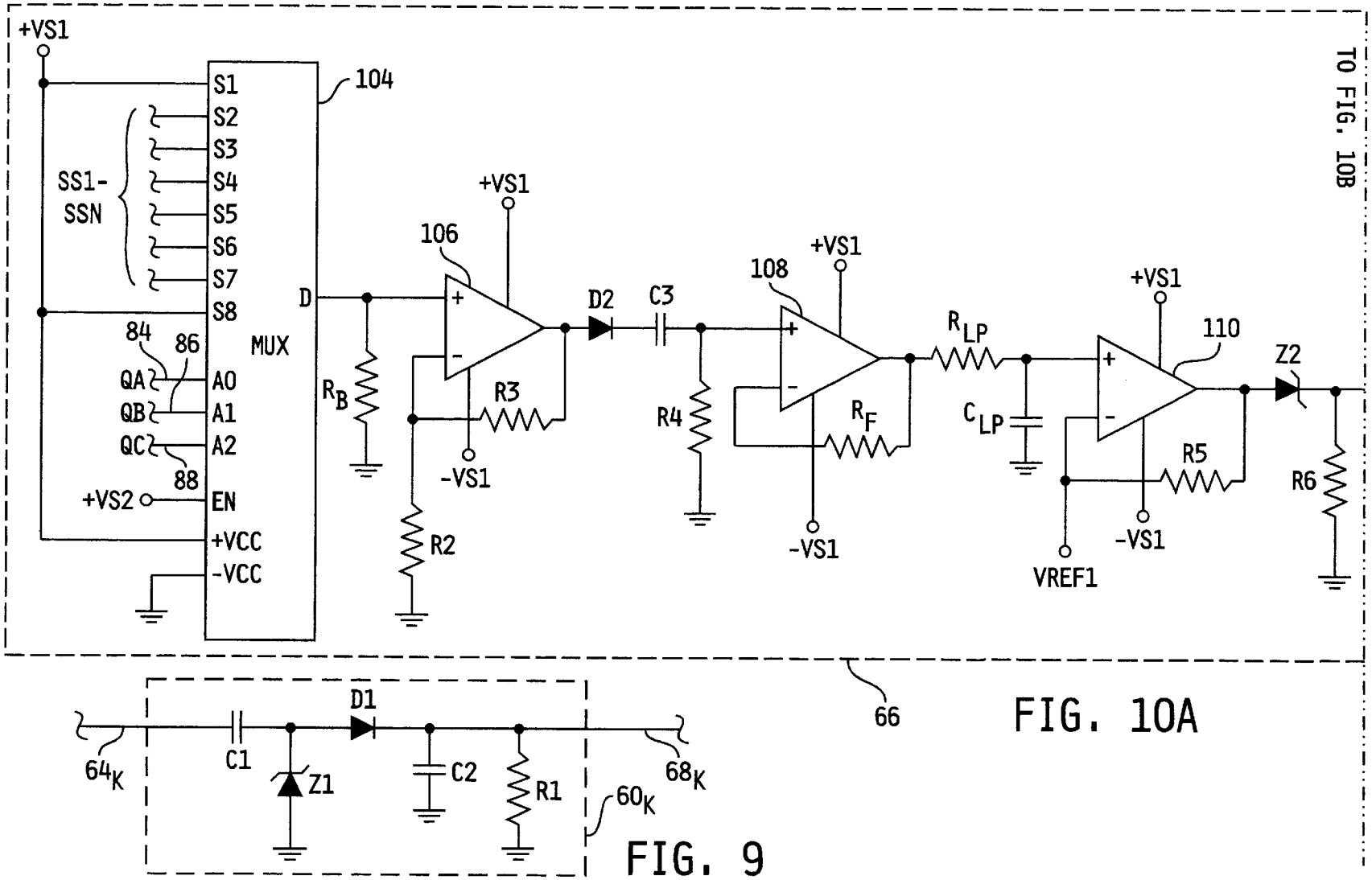
FIG. 9 is a schematic diagram illustrating one preferred embodiment of any of the AC coupling circuits (ACCx) of the system of FIG. 6, in accordance with the present invention.

Referring now to FIG. 9, one preferred embodiment of a $k^{th}$ one of the AC coupling circuits ($\mathbf{60}_1$–$\mathbf{60}_N$), in accordance with the present invention, is shown. Circuit $\mathbf{60}_k$ includes a first capacitor C1 having one end electrically connected to signal line $\mathbf{64}_k$ (e.g., carrying the primary voltage signal PV for the $k^{th}$ primary coil $\mathbf{18}_k$) and an opposite end connected to an anode of a diode D1 and to a cathode of a zener diode Z1. The anode of Z1 is connected to ground potential, and the cathode of D1 is connected to one end of a first resistor R1, to one end of a second capacitor C2 and to output signal path $\mathbf{68}_k$. The opposite ends of R1 and C2 are connected to ground potential.

Capacitor C1 of each of the various AC coupling circuits $\mathbf{60}_k$ is operable to permit passage therethrough of only the AC portion of the respective primary voltage signal PVk, and the zener diode Z1 is operable to clamp the amplitude of this signal at a desired maximum voltage. Diode D1 is operable to provide for one-way signal flow between the primary coil $\mathbf{18}_k$ and the spark detection circuit 66, and resistor R1 is operable to dissipate charge from capacitor C2. The following Table I summarizes component values for one embodiment of the AC coupling circuits $\mathbf{60}_1$–$\mathbf{60}_N$, although it is to be understood that the present invention contemplates other values thereof.

TABLE I

| COMPONENT | VALUE |
|---|---|
| C1 | 5 pF |
| Z1 | 30 volt clamp |
| C2 | 10 pF |
| R1 | 100 kΩ |

Figure 10B:
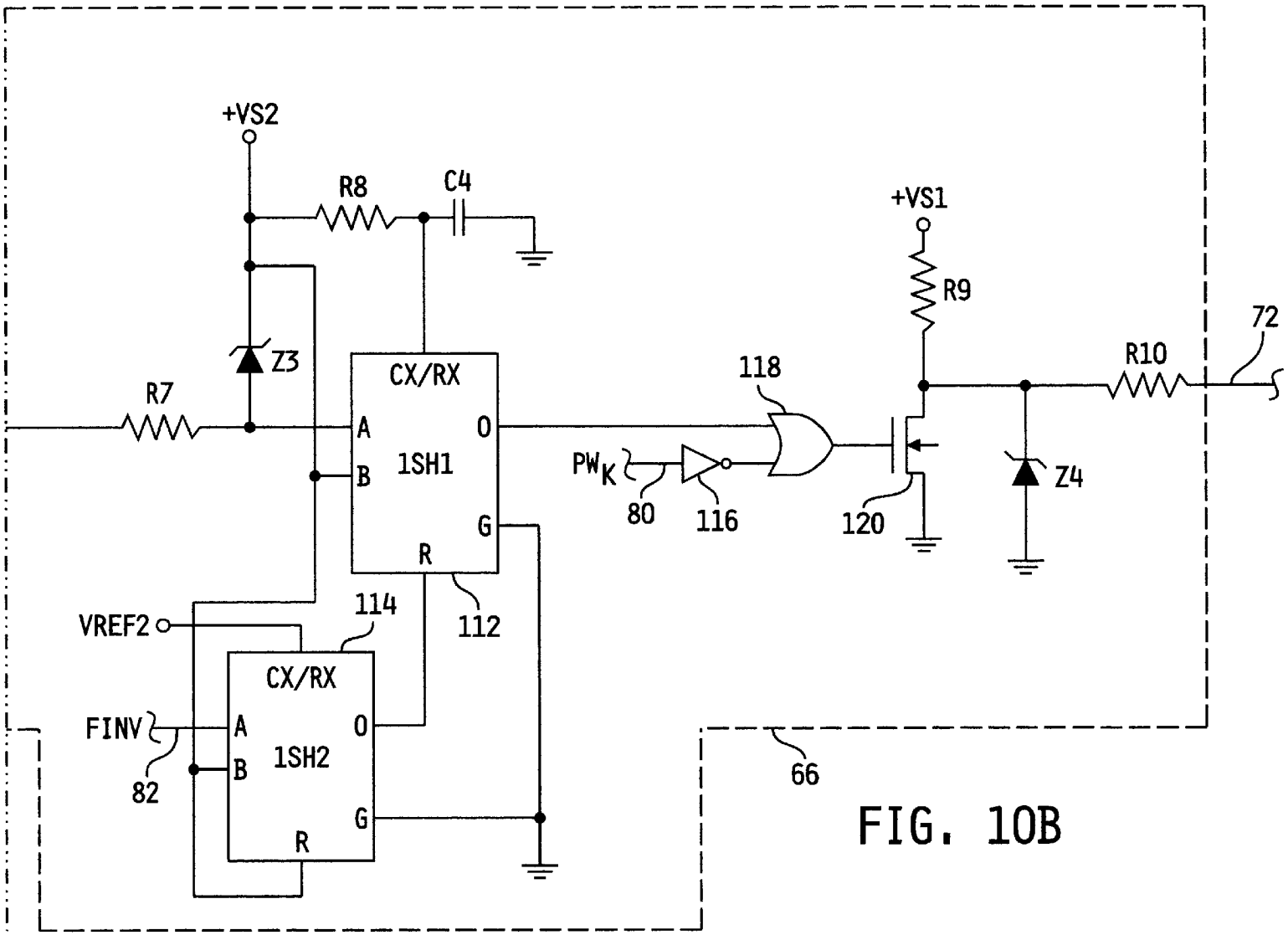
FIG. 10 is a schematic diagram illustrating one preferred embodiment of the spark detection circuit of the system of FIG. 6, in accordance with the present invention.

Referring now to FIG. 10, one preferred embodiment of the spark detection circuit 66, in accordance with the present invention, is shown. Circuit 66 includes a N-to-1 multiplexor (MUX) circuit 104 of known construction referenced to voltage source +VS1 and to ground potential. The embodiment of circuit 66 illustrated in FIG. 10 is configured for a six-cylinder engine and in this regard, MUX circuit 104 includes three inputs A0, A1 and A2 receiving three corresponding address signals QA, QB and QC from PW circuit 74 via signal paths 84, 86 and 88 respectively. As described hereinabove, the number of address lines required for a particular application of system 50 will be dictated by the number of cylinders of engine 98. In general, a sufficient number of address lines must typically be included to allow binary counting of at least the number N of cylinders of engine 98. In the example of circuit 66 shown in FIG. 10, a six-cylinder application requires at least three address lines to accomplish binary counting thereof.

In the embodiment shown, MUX circuit 104 is a known 8-to-1 multiplexor circuit having two inputs S1 and S8 tied to supply voltage +VS1. The remaining six inputs S2–S7 are connected to corresponding SS1–SSN outputs of appropriate ones of the AC coupling circuits $\mathbf{60}_1$–$\mathbf{60}_N$. In general, the inputs S2–S7 of multiplexor circuit 104 are connected to signal paths $\mathbf{68}_1$–$\mathbf{68}_N$ in accordance with the cylinder firing order of the engine. Thus, for example, if the firing order is 1, 5, 3, 6, 2, 4, then S2 is connected to signal path $\mathbf{68}_1$, S3 is connected to signal path $\mathbf{68}_5$, S4 is connected to signal path $\mathbf{68}_3$, and so on.

It is to be understood that multiplexor circuit 104 is illustrated in FIG. 10 as being configured for six-cylinder operation. Those skilled in the art will recognize that circuit 104 may alternatively be configured for operation with any desired number of cylinders, and that the specific number of cylinders will generally dictate the structure and connections thereof. Such circuit substitutions, however, are well within the knowledge of a skilled artisan.

MUX circuit 104 defines an output D that is electrically connected to one end of a bleed resistor $R_B$ referenced at ground potential and to a non-inverting input of an operational amplifier 106 connected in a voltage-follower configuration. The inverting input of amplifier 106 is connected to resistors R2 and R3 with R2 referenced at ground potential and R3 connected at its opposite end to an output of amplifier 106 that is also connected to an anode of diode D2. Amplifier 106 is connected at its positive and negative supply inputs to a DC voltage source +VS1 and −VS1 respectively.

The cathode of D2 is connected to one end of a capacitor C3 having its opposite end connected to one end of a resistor R4 and to a non-inverting input of another operational amplifier 108 connected in voltage follower configuration. The inverting input of amplifier 108 is connected to one end of a feedback resistor RF, the opposite end of which is connected to an output of amplifier 108. The output of amplifier 108 is also connected to one end of a resistor $R_{LP}$ having an opposite end connected to one end of a capacitor $C_{LP}$ and to a non-inverting input of another operational amplifier 110. The opposite end of $C_{LP}$ is connected to ground potential.

The inverting input of amplifier 110 is connected to one end of a resistor R5 and to a DC reference voltage VREF1, and the opposite end of R5 is connected to an output of amplifier 110 and to an anode of a zener diode Z2. As with amplifiers 106 and 108, the positive and negative supply inputs of amplifier 110 are connected to supply voltages +VS1 and −VS1 respectively.

The cathode of Z2 is connected to one end of a resistor R6 referenced at ground potential and to one end of another resistor R7 having an opposite end connected to an anode of a zener diode Z3 and to a first input "A" of a one-shot circuit 112. The cathode of Z3 is connected to a second input "B" of circuit 112, to a "B" input and a reset input "R" of a second one-shot circuit 114, to one end of a resistor R8 and to supply voltage +VS2. The opposite end of R8 is connected to one end of a capacitor C4 and to a clock input "Cx/Rx" of circuit 112. The opposite end of C4 is connected to ground potential. Ground inputs "G" of circuits 112 and 114 are connected together and referenced at ground potential, and the clock input "Cx/Rx" of circuit 114 is connected to a DC reference potential VREF2. The "A" input of circuit 114 is connected to signal path 82 and receives the inverse FIRE signal FINV thereat. The output "O" of circuit 114 is connected to the reset "R" input of circuit 112 and the output "O" of circuit 112 is connected to one input of a two-input OR gate 118. The second input of OR gate 118 is connected to an output of an inverter 116 having an input connected to signal path 80 and receiving the PWk signal thereat. The output of OR gate 118 is connected to a gate of a MOS or other suitable transistor 120 having a source referenced at ground potential and a drain connected to first ends of resistors R9 and R10 and to a cathode of a zener diode Z4. The Opposite end of R9 is connected to supply voltage +VS1 and the opposite end of R10 defines output signal path 72 of circuit 66.

In operation, MUX circuit 104 is operable, under the direction of address signals QA, QB, and QC to pass the AC-coupled PVk signals in appropriate order and timing to amplifier 106. Amplifier 106 is connected in a voltage-follower configuration and is operable to buffer and increase the spark event signal. Capacitor C3 and resistor R4 comprise a known first order high-pass filter used to separate the reflected spark event from the primary voltage pulse PVk. Voltage-follower 108 is operable to clean up the pulse edges produced by the high-pass filter comprising C3 and R4, and resistor $R_{LP}$ and capacitor $C_{LP}$ comprise a known first order low-pass filter operable to remove unwanted noise from the spark signal.

Operational amplifier 110 and associated circuitry define a level detector referenced at a desired DC reference level VREF1, wherein VREF1 is typically dictated by the particular ignition circuit implementation and an appropriate choice therefore is within the knowledge of a skilled artisan. Zener diode Z2 reduces ringing on the signal produced by amplifier 110 and one-shot circuit 112 is operable to produce a rising edge at output "O" thereof coincident with a rising edge of the spark signal at the "A" input of circuit 112 when its reset input "R" is activated. One-shot circuit 114 is responsive to the FINV signal to provide a predetermined delay period between the falling edge of the FIRE signal and activation of the reset "R" input of one-shot circuit 112. This predetermined delay period is set by the DC reference voltage VREF2 and is preferably chosen such that the reset "R" input of one-shot circuit 112 is not activated until after the PVk voltage has transitioned from V3 to V4 (see FIG. 5) to avoid false detection of this transition as a spark event. In one embodiment, VREF2 is chosen such that the delay "D" of FIG. 7 is approximately 5–10 microseconds, although other delay times are contemplated wherein any such desired delay period may easily be set by a skilled artisan via appropriate choice of VREF2.

Resistor R8 and capacitor C4 are chosen to provide for an active reflected spark event output signal at output "O" of one-shot circuit 112 having an active time period in excess of the duration of the $PW_k$ signal of FIG. 7. The falling edge of $PW_k$ is operable to deactivate the reflected spark event signal through OR gate 118, and zener diode Z4 is operable to clamp the maximum amplitude of the reflected spark event (RSE) signal on signal path 74 at its clamping voltage (e.g., 5.1 volts.

The following Table II summarizes component and voltage source values for one embodiment of the spark detection circuit 66, although it is to be understood that the present invention contemplates other values thereof.

TABLE II

| COMPONENT | VALUE |
|---|---|
| C3 | 47 pF |
| $C_{LP}$ | 47 $\mu$F |
| C4 | 1000 pF |
| $R_B$ | 15 kΩ |
| R2 | 8.25 kΩ |
| R3 | 10.2 kΩ |
| R4 | 24 kΩ |
| RF | 1 kΩ |

TABLE II-continued

| COMPONENT | VALUE |
|---|---|
| $R_{LP}$ | 2 kΩ |
| R5 | 1 kΩ |
| R6 | 100 kΩ |
| R7 | 1 kΩ |
| R8 | 150 kΩ |
| R9 | 100 Ω (5 watt) |
| R10 | 100 Ω (5 watt) |
| Z3 | 30 volts clamping voltage |
| Z4 | 5.1 volts clamping voltage |
| VS1 | 12 volts |
| VS2 | 5 volts |
| Multiplexor 104 | ADG 508F |

Figures 11, 12:
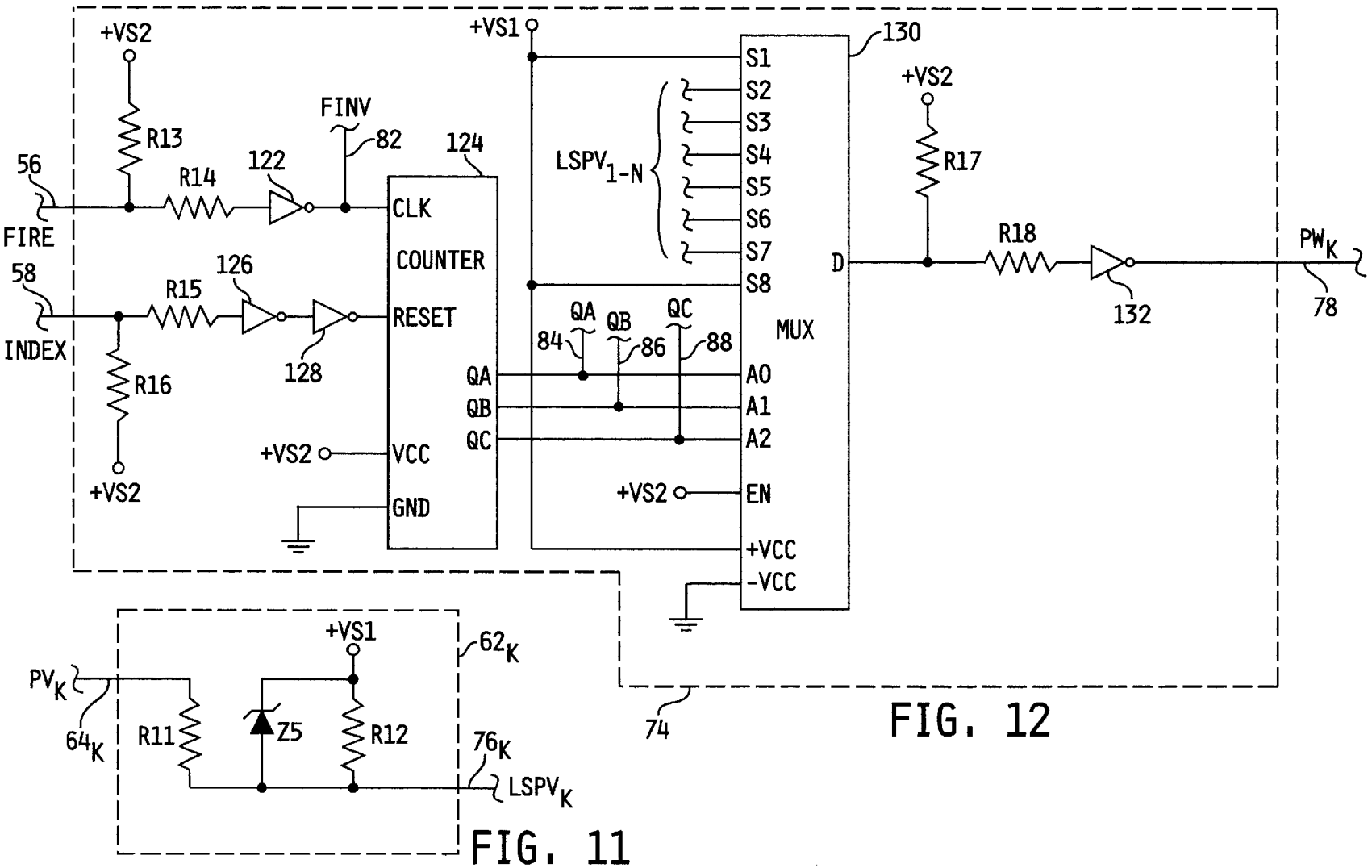
FIG. 11 is a schematic diagram illustrating one preferred embodiment of any of the level shifting (LSx) circuits of the system of FIG. 6, in accordance with the present invention.
FIG. 12 is a schematic diagram illustrating one preferred embodiment of the pulse width (PW) circuit of the system of FIG. 6, in accordance with the present invention.

Referring now to FIG. 11, one preferred embodiment of a $k^{th}$ one of the level shifting circuits ($62_1$–$62_N$), in accordance with the present invention, is shown. Circuit $62_k$ includes a resistor R11 having one end electrically connected to signal path $64_k$ (and receiving the primary voltage signal PVk) and an opposite end connected to one end of a resistor R12, to an anode of a zener diode Z5 and defining output signal path $76_k$. The opposite end of R12 and the cathode of Z5 are connected to supply voltage +VS1. Resistors R11 and R12 limit the current on signal path $64_k$ and set up drive current for PW circuit 74, and zener diode Z5 clamps the maximum amplitude of the PVk signal at a desired (e.g., 5.6 volts) maximum voltage level. Table III below summarizes component values for one preferred embodiment of level-shifting circuit $62_k$, although the present invention contemplates other values thereof.

TABLE III

| COMPONENT | VALUE |
|---|---|
| R11 | 270 kΩ |
| R12 | 39 kΩ |
| Z5 | 5.6 volts clamping voltage |
| VS1 | 12 volts |

Referring now to FIG. 12, one preferred embodiment of the pulse width circuit 74, in accordance with the present invention, is shown. Circuit 74 includes a resistor R13 and a resistor R14 each having one end electrically connected to signal path 56 and receiving the FIRE signal thereat. The opposite end of R13 is connected to supply voltage +VS2 and the opposite end of R14 is connected to an input of an inverter 122. The output of inverter 122 is connected to a clock "CLK" input of a counter circuit 124. Resistors R15 and R16 each have one end electrically connected to signal path 58 and receiving the INDEX signal thereat. The opposite end of R16 is connected to supply voltage +VS2 and the opposite end of R15 is connected to an input of an inverter 126. The output of inverter 126 is connected to an input of another inverter 128, and the output of inverter 128 is connected to a RESET input of counter circuit 124. Counter circuit 124 is referenced to supply voltage +VS2.

The embodiment of circuit 74 illustrated in FIG. 12 is configured for a six-cylinder engine and in this regard, counter circuit 124 includes three outputs QA, QB and QC connected to three corresponding address inputs A0, A1 and A2 of an N-to-1 multiplexor circuit 130. In the embodiment shown, multiplexor circuit 130 is a known 8-to-1 multiplexor circuit having two inputs S1 and S8 tied to supply voltage +VS1. The remaining six inputs S2–S7 are connected to corresponding LSPV outputs of appropriate ones of the level shifting circuits LS1–LSN. In general, the inputs S2–S7 of multiplexor circuit 130 are connected to signal paths $76_1$–$76_N$ in accordance with the cylinder firing order of the engine. Thus, for example, if the firing order is 1, 5, 3, 6, 2, 4, then S2 is connected to signal path $76_1$, S3 is connected to signal path $76_5$, S4 is connected to signal path $76_3$, and so on.

It is to be understood that counter circuit 124 and multiplexor circuit 130 are illustrated in FIG. 11 as being configured for six-cylinder operation. Those skilled in the art will recognize that circuit 74 may alternatively be configured for operation with any desired number of cylinders, and that the specific number of cylinders will generally dictate the structure and connections of counter 124 and multiplexor 130. Such circuit substitutions, however, are well within the knowledge of a skilled artisan.

The output "D" of MUX 130 is connected to one end of a resistor R17 having an opposite end referenced at supply voltage +VS2, and to one end of another resistor R18 having an opposite end connected to an input of an inverter 132. The opposite end of inverter 132 defines the output signal path 78 of PW circuit 74.

In operation, the pulse width circuit 74 switches the analog channels in the predefined firing order in accordance with the FIRE and INDEX signals. The counter circuit 124 decodes the FIRE and INDEX signals and provides corresponding address signals to the multiplexor circuit 130. Multiplexor 130, in turn, converts the N level-shifted input signals $LSPV_{1-N}$ to a single channel that is then provided to inverter 132. The output of inverter 132 defines the output signal path 78 of circuit 132 and accordingly carries the $PW_k$ signal. Table IV below summarizes component values for one preferred embodiment of pulse width circuit 74, although the present invention contemplates other values thereof.

TABLE IV

| COMPONENT | VALUE |
|---|---|
| R13 | 10 kΩ |
| R14 | 8.2 kΩ |
| R15 | 8.2 kΩ |
| R16 | 10 kΩ |
| R17 | 39 kΩ |
| R18 | 560 kΩ |
| VS1 | 12 volts |
| VS2 | 5 volts |
| Counter 124 | 74HC393 |
| Multiplexor 130 | ADG408 |

Figure 13A:
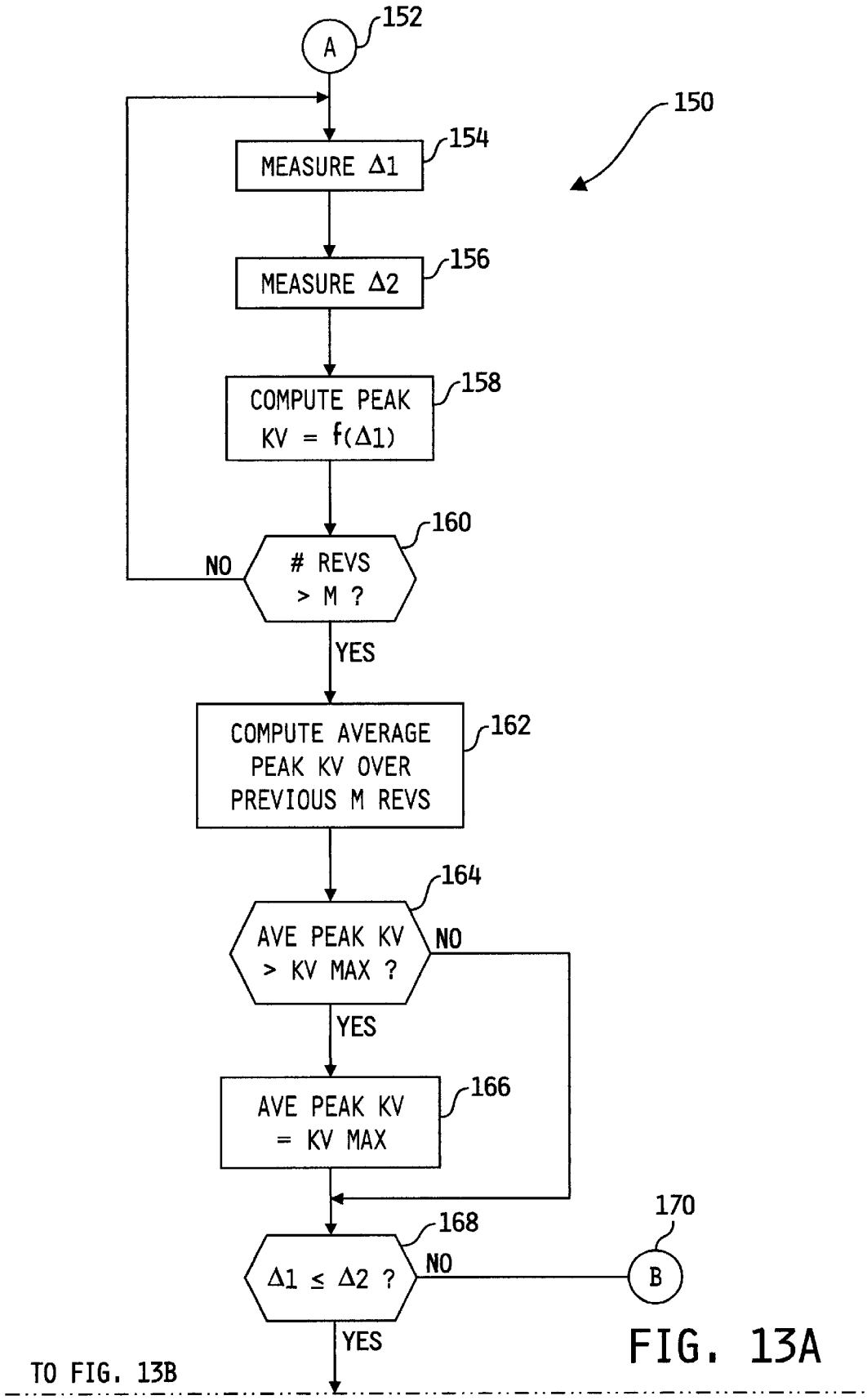
FIGS. 13A and 13B show a flowchart illustrating one preferred embodiment of a software algorithm for diagnosing the ignition system of FIG. 6 and determining component fault conditions as a function of the primary coil voltage, in accordance with the present invention.
Figure 13B:
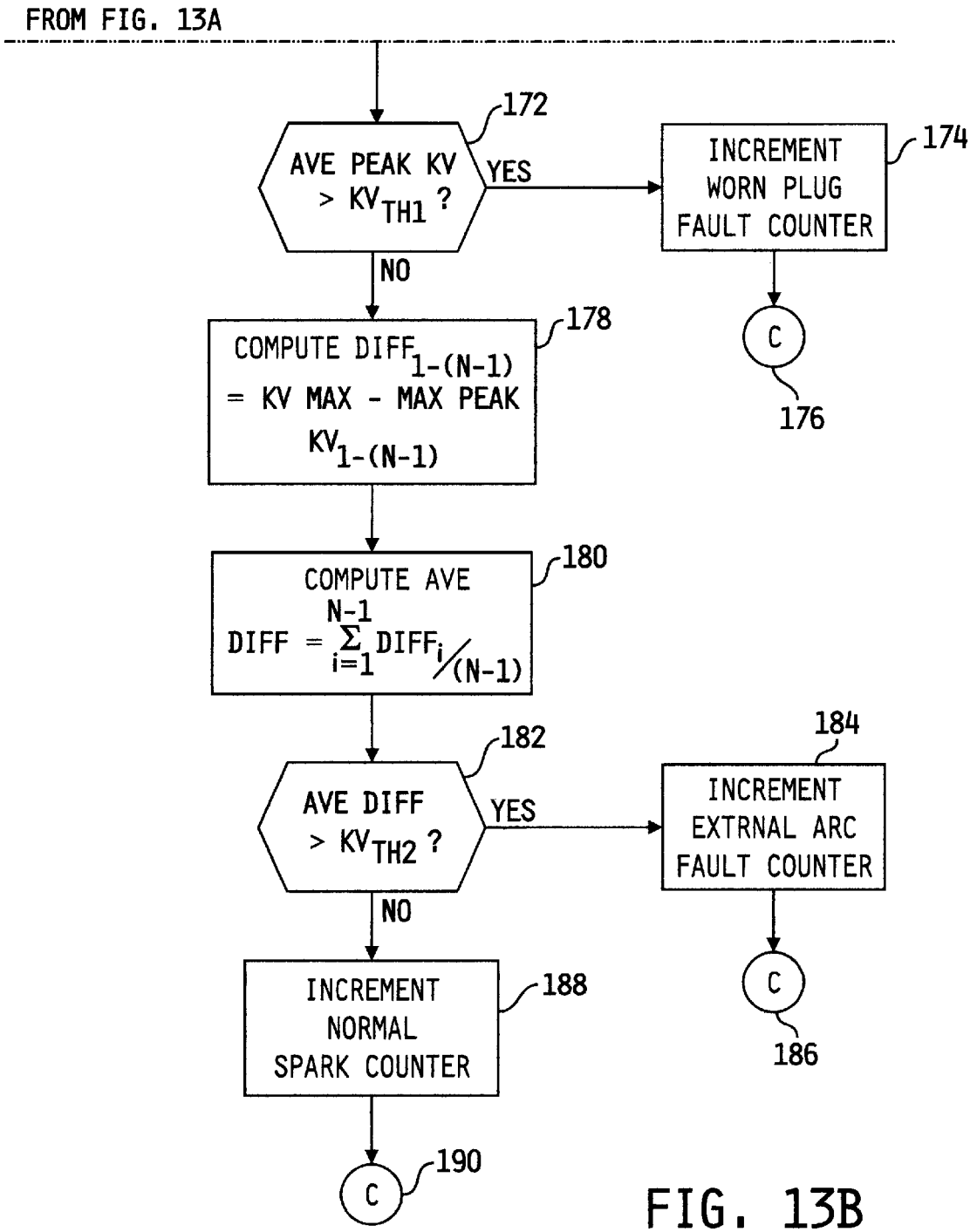

Referring now to FIGS. 13A and 13B, a flowchart is shown illustrating one preferred embodiment of a software algorithm 150 for controlling system 50 of FIG. 6 to determine diagnostic information relating to the health and/or operational status of one or more of the components of system 50. Algorithm 150 is preferably stored within memory 75 of signal processing circuit 70 (FIG. 6) and is executed by signal processing circuit 70. Algorithm 150 begins at step "A" 152 and thereafter at step 154, circuit 70 is operable to measure the time duration Δ1 for the $k^{th}$ cylinder as illustrated in FIG. 7. Preferably, circuit 70 is operable to execute step 154 by monitoring the signals RSE and $PW_k$ at the spark signal input SP and pulse width input PW respectively thereof, and measuring the time duration between the rising edge of $PW_k$ and the rising edge of RSE. Thereafter at step 156, circuit 70 is operable to measure the time duration Δ2 for the $k^{th}$ cylinder as illustrated in FIG. 7. Preferably, circuit 70 is operable to measure the time duration Δ2 by monitoring the $PW_k$ signal at the pulse width input PW thereof and measuring the time duration between the rising and falling edges of the $PW_k$ signal.

From step 156, algorithm 150 advances to step 158 where circuit 70 is operable to compute a peak voltage (kV) of the spark voltage across the secondary coil $28_k$ as a function of Δ1. More specifically, the peak spark voltage is equal to the product of Δ1 and a so-called rise time $R_T$ (typically in kV/microseconds) of the ignition coil $20_k$, wherein $R_T$ is generally a function of the physical characteristics of the ignition coil $20_k$. The peak spark voltage will therefore be dictated not only by Δ1 but will also be defined by the characteristic rise time $R_T$, and circuit 70 is therefore preferably operable at step 158 to compute the peak spark voltage according to the equation peak kV=$R_T$*Δ1. Thereafter at step 160, circuit 70 is operable to compare the number of cam revolutions (REVS) with a predefined constant. Preferably, circuit 70 is operable to track a current count of cam revolutions by monitoring the FIRE and/or INDEX signals and determining REVS therefrom as is known in the art. In one embodiment of algorithm 150, the constant M is preferably set at 10, although other values for M are contemplated. In any case, if circuit 70 determines at step 160 that REVS is less than or equal to M, algorithm execution loops back to step 154. If, however, REVS is greater than M at step 160, algorithm execution advances to step 162.

At step 162, circuit 70 is operable to compute an average peak kV over the previous M cam revolutions, preferably in accordance with an algebraic average (e.g., Ave peak kV=$\Sigma^{REVS}_{REVS-M}$ peak kV/M). Thereafter at step 164, circuit 70 is operable to compare the average peak kV with a running maximum value thereof. If ave peak kV is greater than the current value of kV max, algorithm execution advances to step 166 where circuit 70 sets the kV max value to the current ave peak kV value. Otherwise, algorithm execution advances to step 168. It is anticipated that the average kV value will initially increase in value over the first few cam revolutions and then stabilize thereafter. Steps 164 and 166 are accordingly included to maintain an accurate value of the current maximum value of the average peak kV.

At step 168, circuit 70 is operable to compare time durations Δ1 and Δ2. If Δ1 is less than or equal to Δ2, then system 50 is presumed to be operating normally and algorithm 150 advances to step 172 for further analysis of the average peak kV. If, however, circuit 70 determines at step 168 that Δ1 is greater than Δ2, then the reflected spark event in the primary coil voltage PVk has not been detected and algorithm execution advances to step 170 where a diagnostic subroutine B is executed as will be described hereinafter with respect to FIG. 14.

From the "YES" branch of step 168, algorithm execution advances to step 172 where circuit 70 is operable to compare the average peak kV determined at step 162 to a first threshold kV value $kV_{TH1}$. If ave peak kV is less than or equal to $kV_{TH1}$, system 50 is presumed to be operating normally and algorithm 150 advances to step 178 for further analysis. If, however, circuit 70 determines that ave peak kV is greater than $kV_{TH1}$, algorithm execution advances to step 174 where circuit 70 increments a "worn plug" fault counter and advances therefrom to another diagnostic subroutine C at step 176, wherein details of subroutine C will be described in greater detail hereinafter with respect to FIGS. 15A and 15B. In any case, the threshold $kV_{TH1}$ is set in one embodiment to 27, although other values of $kV_{TH1}$ are contemplated. In any case, the value of $kV_{TH1}$ is preferably set at a value above which the peak kV value is considered to be excessively high for normal operating conditions. Thus, if the average peak kV value for the $k^{th}$ cylinder is greater than $kV_{TH1}$, kV, a worn ignition plug condition is presumed and a worn plug fault counter is accordingly incremented.

From the "NO" branch of step 172, algorithm execution advances to step 178 where circuit 70 is operable to compute difference values between the maximum peak kV value for the kth cylinder and the maximum peak kV values for the remaining N−1 cylinders. Thus, for a six cylinder engine, step 178 will result in five difference values. Thereafter at step 180, circuit 170 is operable to compute an average difference value preferably as an algebraic average of the N−1 difference values computed at step 178. Thereafter at step 182, circuit 70 is operable to compare the average difference value computed at step 182 with a second kV threshold $kV_{TH2}$. If the average difference value is less than or equal to $kV_{TH2}$, algorithm 150 advances to step 188 where circuit 70 increments a "normal spark" counter" before advancing to subroutine C at step 190. If, however, the average difference value computed at step 180 is greater than $kV_{TH2}$ at step 182, algorithm execution advances to step 184 where circuit 70 is operable to increment an "external arc" fault counter before advancing to subroutine C at step 186. In one preferred embodiment, the threshold $kV_{TH2}$ is set to 5, although other values of $kV_{TH2}$ are contemplated. In any case, the value of $kV_{TH2}$ is preferably set at a value above which the average difference between the maximum peak kV value for the $k^{th}$ cylinder and the maximum peak kV values for the remaining cylinders is considered to be excessively high for normal operating conditions. Thus, if the average difference value for the $k^{th}$ cylinder is greater than $kV_{TH2}$ kV, an external arcing condition is presumed and an external arc fault counter is accordingly incremented. In general, an external arcing condition is defined for purposes of the present invention as any arc, spark or ionization event that occurs outside of a pressurized engine cylinder. External arc events with respect to system 50 may occur, for example, anywhere in the secondary coil circuit including between an external component and the ignition plug, plug wire, plug boot, secondary coil wire, etc. It has been observed, however, that an external arc associated with the secondary coil occurs at least in one known system at distinctively lower voltages than other external arc events (e.g., those associated with the ignition plug, plug wire, plug boot, etc.). Those skilled in the art will recognize that algorithm 150 may be easily modified to accordingly discriminate between external arc events associated with the secondary coil and external arc events associated with the other components of the secondary coil circuit, and such modifications to algorithm 150 are well within the knowledge of a skilled artisan.

Figure 14:
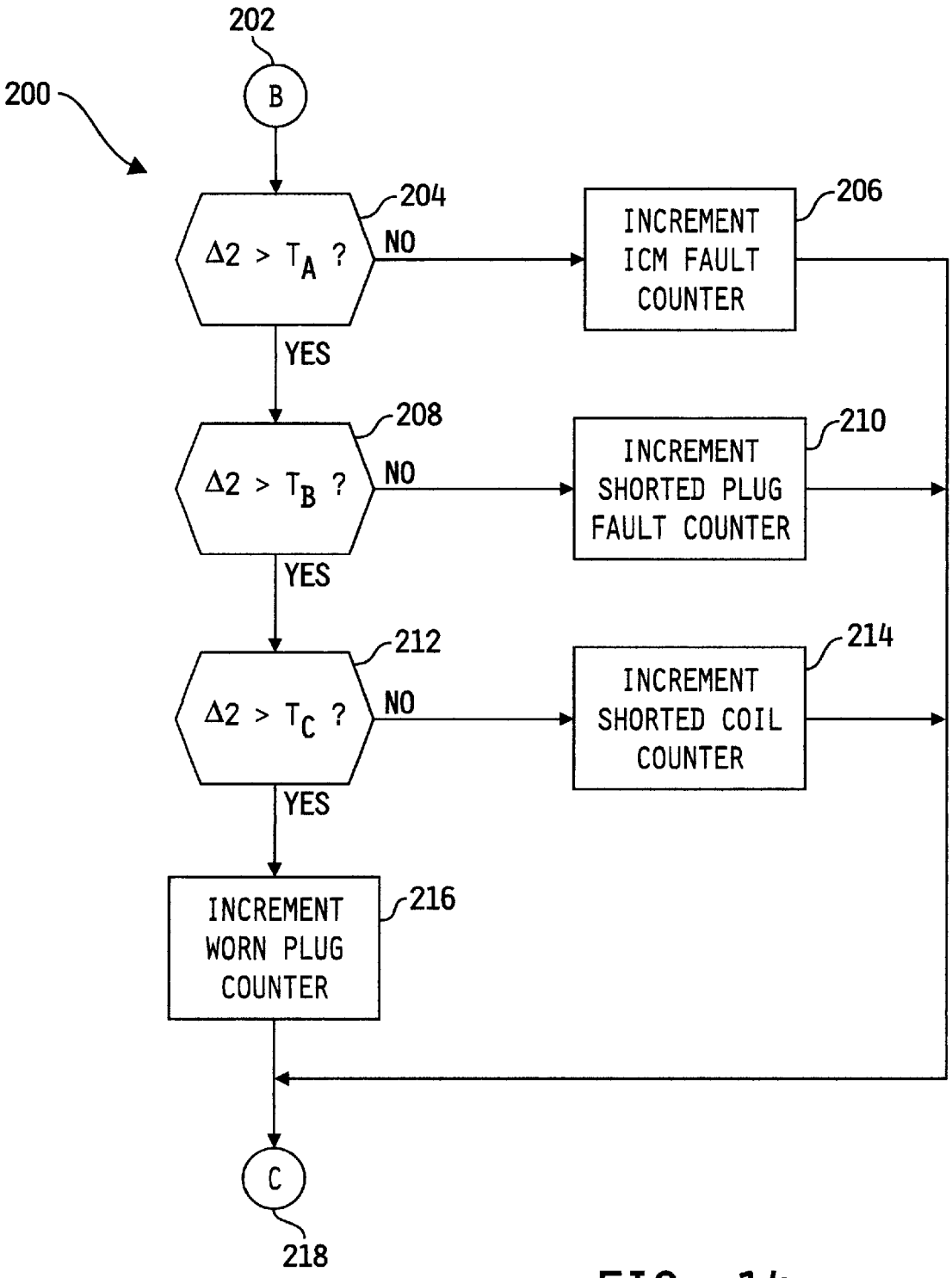
FIG. 14 shows another flowchart illustrating a diagnostic subroutine used by the algorithm of FIGS. 13A and 13B, in accordance with the present invention.

Referring now to FIG. 14, a flowchart is shown illustrating one preferred embodiment of an algorithm 200 for executing subroutine B described with respect to algorithm 150 of FIGS. 13A and 13B. Algorithm B (200) begins at step 202 and advances therefrom to step 204 where circuit 70 is operable to compare the duration Δ2 of the pulse signal $PW_k$ a threshold time value $T_A$. If Δ2 is greater than $T_A$ at step 204, algorithm execution advances to step 208. If however, circuit 70 determines at step 204 that Δ2 is less than or equal to $T_A$, algorithm execution advances to step 206 where circuit 70 is operable to increment an "ICM" fault counter before advancing to subroutine C at step 218. In one preferred embodiment, $T_A$ is set at 25 μs, although other values of $T_A$ are contemplated. In any case, algorithm 200 is preferably configured such than if Δ1 is not detected within Δ2 (Δ1≦Δ2 at step 168 of algorithm 150) and Δ2 is less than or equal to $T_A$, a fault associated with the ignition control module 100 (FIG. 8) is presumed and circuit 70 is operable to accordingly increment an ICM fault counter.

At step 208, circuit 70 is operable to compare the duration Δ2 of the pulse signal $PW_k$ a threshold time value $T_B$. If Δ2 is greater than $T_B$ at step 208, algorithm execution advances to step 212. If however, circuit 70 determines at step 208 that Δ2 is less than or equal to $T_B$, algorithm execution advances to step 210 where circuit 70 is operable to increment a "shorted plug" fault counter before advancing to subroutine C at step 218. In one preferred embodiment, $T_B$ is set at 50 μs, although other values of $T_B$ are contemplated. In any case, algorithm 200 is preferably configured such than if Δ1 is not detected within Δ2 (Δ1≦Δ2 at step 168 of algorithm 150) and Δ2 is greater than $T_A$ but less than or equal to $T_B$, a shorted ignition plug condition is presumed and circuit 70 is operable to accordingly increment a shorted plug fault counter.

At step 212, circuit 70 is operable to compare the duration Δ2 of the pulse signal $PW_k$ a threshold time value $T_C$. If Δ2 is greater than $T_C$ at step 212, algorithm execution advances to step 216. If however, circuit 70 determines at step 212 that Δ2 is less than or equal to $T_C$, algorithm execution advances to step 214 where circuit 70 is operable to increment a "shorted coil" fault counter before advancing to subroutine C at step 218. In one preferred embodiment, $T_C$ is set at 70 μs, although other values of $T_C$ are contemplated. In any case, algorithm 200 is preferably configured such than if Δ1 is not detected within Δ2 (Δ1≦Δ2 at step 168 of algorithm 150) and Δ2 is greater than $T_B$ but less than or equal to $T_C$, a shorted ignition coil condition is presumed and circuit 70 is operable to accordingly increment a shorted coil fault counter.

At step 216, circuit 70 is operable to increment the "worn plug" counter before advancing to subroutine C at step 218. Algorithm 200 is preferably configured such than if Δ1 is not detected within Δ2 (Δ1≦Δ2 at step 168 of algorithm 150) and Δ2 is greater than $T_C$, a worn ignition pug condition is presumed and circuit 70 is operable to accordingly increment a worn plug fault counter.

Figure 15A:
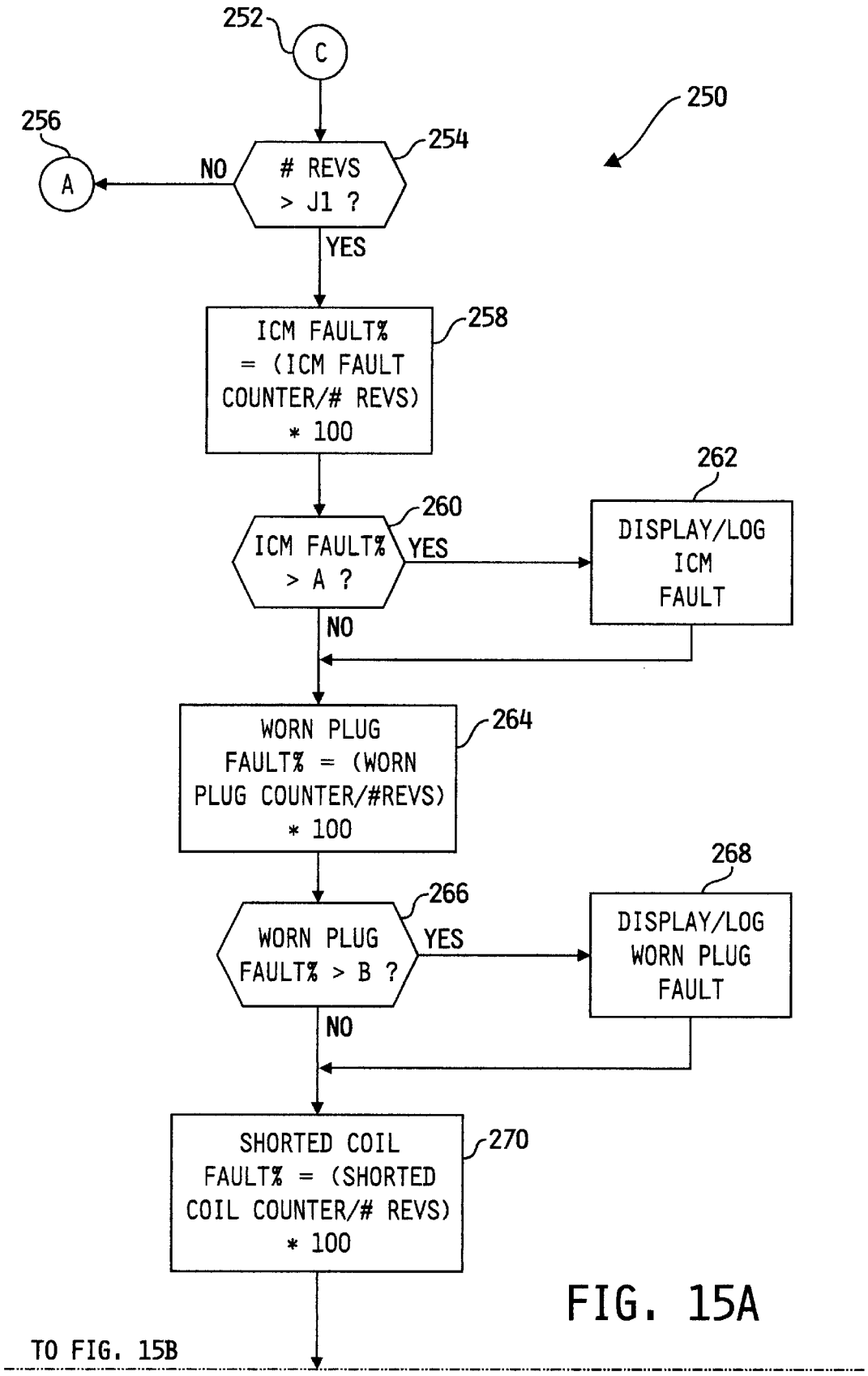
FIGS. 15A and 15B show yet another flowchart illustrating a diagnostic/display algorithm used by the algorithms of FIGS. 13A–13B and 14.
Figure 15B:
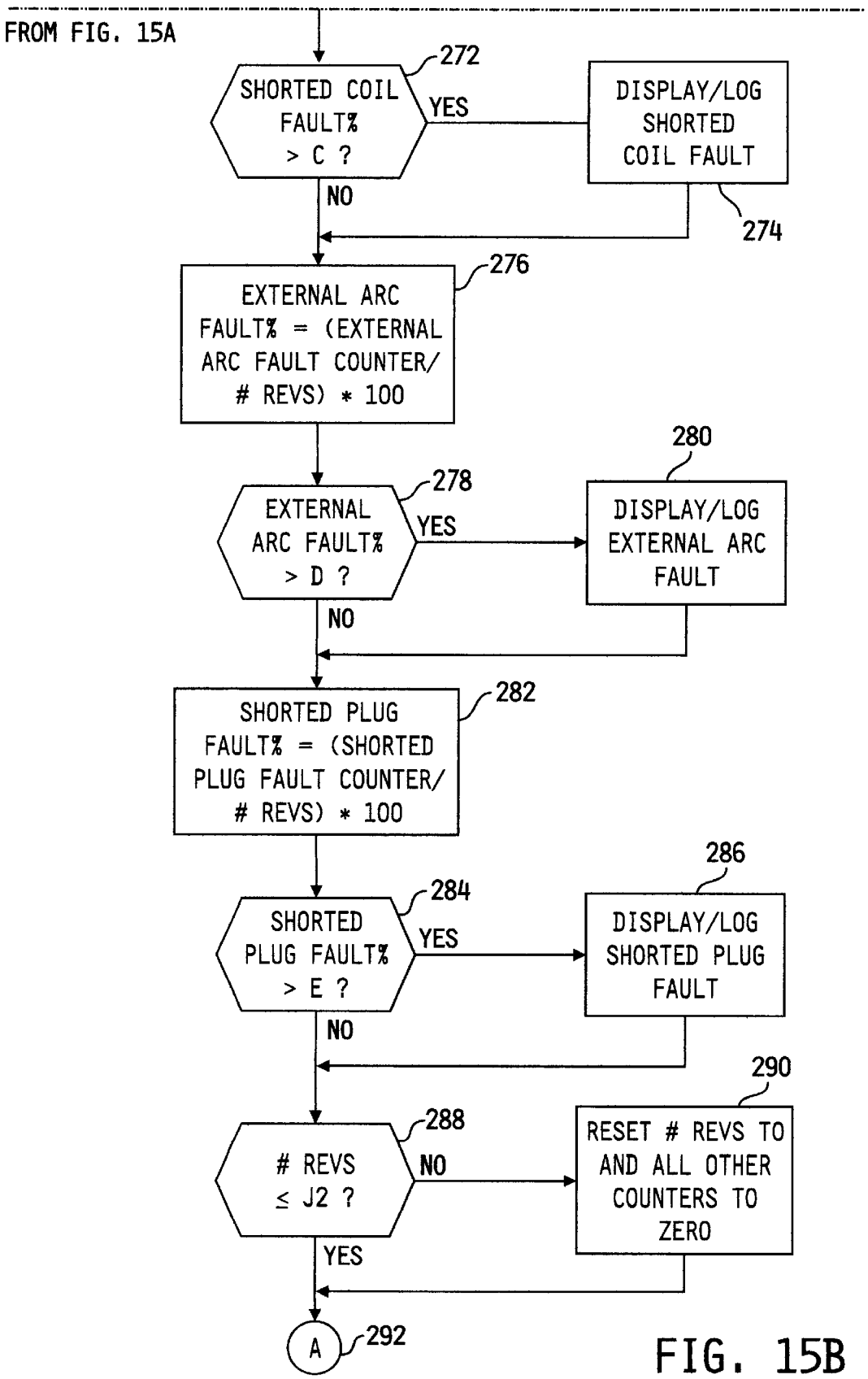

Referring now to FIGS. 15A and 15B, a flowchart is shown illustrating one preferred embodiment of an algorithm 250 for executing subroutine C described with respect to algorithm 150 of FIGS. 12A and 12B and algorithm 200 of FIG. 14. Algorithm C (250) begins at step 252 and advances therefrom to step 254 where circuit 70 is operable to compare the current number of cam revolutions REVS to a predefined constant J1. If REVS is greater than J1 at step 254, algorithm execution advances to step 258. If, however, circuit 70 determines at step 254 that REVS is less than or equal to J1, algorithm 250 returns to algorithm 150 of FIGS. 13A and 13B via step 256. Step 254 is preferably included in algorithm 250 to allow accumulation of data over a predefined number of firing cycles before executing the diagnostic subroutine C. In one preferred embodiment, J1 is set to 50 cycles, although the present invention contemplates other values therefore.

Algorithm 250 advances from the YES branch of step 254 to step 258 where circuit 70 is operable to compute an ICM fault percentage value as a ratio of a current value of the ICM fault counter and the current value of REVS to thereby provide information relating to the number of occurrences of an ICM fault indication relative to the current total of cam revolutions. Specifically, circuit 70 is operable at step 258 to compute the ICM fault percentage according to the equation ICM fault %=(ICM fault counter/#REVS)*100. From step 258, algorithm 250 advances to step 260 where circuit 70 is operable to compare the ICM fault percentage value computed at step 258 to a predefined constant A. If ICM fault % is less than or equal to A, algorithm 250 advances to step 264. However, if at step 260 circuit 70 determines that ICM fault % is greater than A, algorithm 250 advances to step 262 where circuit 70 is operable to display the ICM fault information on display 87 and/or log an ICM fault code in memory 75 before advancing to step 264. In one preferred embodiment, the predefined constant A is set at 20, although the present invention contemplates other values thereof.

At step 264, circuit 70 is operable to compute a worn plug fault percentage value as a ratio of a current value of the worn plug fault counter and the current value of REVS to thereby provide information relating to the number of occurrences of a worn plug fault indication relative to the current total of cam revolutions. Specifically, circuit 70 is operable at step 264 to compute the worn plug fault percentage according to the equation worn plug fault %=(worn plug fault counter/#REVS)*100. From step 264, algorithm 250 advances to step 266 where circuit 70 is operable to compare the worn plug fault percentage value computed at step 264 to a predefined constant B. If worn plug fault % is less than or equal to B, algorithm 250 advances to step 270. However, if at step 266 circuit 70 determines that worn plug fault % is greater than B, algorithm 250 advances to step 268 where circuit 70 is operable to display the worn plug fault information on display 87 and/or log a worn plug fault code in memory 75 before advancing to step 270. In one preferred embodiment, the predefined constant B is set at 5, although the present invention contemplates other values thereof.

At step 270, circuit 70 is operable to compute a shorted coil fault percentage value as a ratio of a current value of the shorted coil fault counter and the current value of REVS to thereby provide information relating to the number of occurrences of a shorted coil fault indication relative to the current total of cam revolutions. Specifically, circuit 70 is operable at step 270 to compute the shorted coil fault percentage according to the equation shorted coil fault %=(shorted coil fault counter/#REVS)*100. From step 270, algorithm 250 advances to step 272 where circuit 70 is operable to compare the shorted coil fault percentage value computed at step 270 to a predefined constant C. If shorted coil fault % is less than or equal to C, algorithm 250 advances to step 276. However, if at step 270 circuit 70 determines that shorted coil fault % is greater than C, algorithm 250 advances to step 274 where circuit 70 is operable to display the shorted coil fault information on display 87 and/or log a shorted coil fault code in memory 75 before advancing to step 276. In one preferred embodiment, the predefined constant C is set at 5, although the present invention contemplates other values thereof.

At step 276, circuit 70 is operable to compute an external arc fault percentage value as a ratio of a current value of the external arc fault counter and the current value of REVS to thereby provide information relating to the number of occurrences of an external arc fault indication relative to the current total of cam revolutions. Specifically, circuit 70 is operable at step 276 to compute the external arc fault percentage according to the equation external arc fault %=(external arc fault counter/#REVS)*100. From step 276, algorithm 250 advances to step 278 where circuit 70 is operable to compare the external arc fault percentage value computed at step 276 to a predefined constant D. If external arc fault % is less than or equal to C, algorithm 250 advances to step 282. However, if at step 278 circuit 70 determines that external arc fault % is greater than D, algorithm 250 advances to step 280 where circuit 70 is operable to display the external arc fault information on display 87 and/or log an external arc fault code in memory 75 before advancing to step 282. In one preferred embodiment, the predefined constant D is set at 5, although the present invention contemplates other values thereof.

At step 282, circuit 70 is operable to compute a shorted plug fault percentage value as a ratio of a current value of the shorted plug fault counter and the current value of REVS to thereby provide information relating to the number of occurrences of a shorted plug fault indication relative to the current total of cam revolutions. Specifically, circuit 70 is operable at step 282 to compute the shorted plug fault percentage according to the equation shorted plug fault %=(shorted plug fault counter/#REVS)*100. From step 282, algorithm 250 advances to step 264 where circuit 70 is operable to compare the shorted plug fault percentage value computed at step 282 to a predefined constant E. If shorted plug fault % is less than or equal to E, algorithm 250 advances to step 288. However, if at step 284 circuit 70 determines that shorted plug fault % is greater than E, algorithm 250 advances to step 286 where circuit 70 is operable to display the shorted plug fault information on display 87 and/or log a shorted plug fault code in memory 75 before advancing to step 288. In one preferred embodiment, the predefined constant E is set at 10, although the present invention contemplates other values thereof.

At step 288, circuit 70 is operable to again compare the current number of cam revolutions REVS to a predefined constant J2. If at step 288 circuit 70 determines that REVS is less than or equal to J2, algorithm 250 returns to the main algorithm A of FIGS. 12A and 12B via step 292. If, however, circuit 70 determines at step 288 that REVS is greater than J2, algorithm 250 advances to step 290 where circuit 70 is operable to reset the REVS counter and all other counters to zero.

Alternatively, circuit 70 may be operable at step 290 to reset the various counters to desired default values therefore. Algorithm 250 advances from step 290 to step 292.

From the foregoing, it should now be apparent that the ignition system diagnostic strategy of the present invention utilizes two main sets of circuits to estimate the breakdown voltage of the various ignition plugs and to diagnose any existing ignition system faults. Both sets of circuits; namely the combination AC coupling circuits $60_1$–$60_N$ and spark detection circuit 66, and the combination level shifting circuits $62_1$–$62_N$ and pulse width circuit 74, accomplish their respective tasks by processing the various primary coil voltages PV1–PVN. The combination AC coupling circuits $60_1$–$60_N$ and spark detection circuit 66 creates a digital RSE pulse when the corresponding spark breakdowns are reflected from the secondary coils back to the respective primary coils. The pulse width circuit 74 creates digital $PW_k$ pulses each timed to match the non-zero voltage times of the various primary voltage signals PV1–PVN. The microprocessor-based signal processing circuit 70 uses both the RSE and $PW_k$ signals to determine various ignition system component fault conditions including shorted ignition coils, worn ignition plugs, shorted ignition plugs, external arcing and ICM faults. These fault conditions are communicated to a service technician via display 87 and/or by logging such fault conditions in memory.

While the invention has been illustrated and described in detail in the foregoing drawings and description, the same is to be considered as illustrative and not restrictive in character, it being understood that only one preferred embodiment thereof has been shown and described and that all changes and modifications that come within the spirit of the invention are desired to be protected.

What is claimed is:

1. In a capacitive discharge ignition system for an internal combustion engine, a method of diagnosing ignition system fault conditions comprising the steps of:

measuring a first time difference between an onset of capacitive discharge and occurrence of a reflected spark event in a primary coil voltage of a capacitive discharge ignition system for an internal combustion engine; and determining at least one ignition system fault condition as a function of said first time difference.

2. The method of claim 1 wherein the determining step includes:

computing a peak spark voltage as a function of said first time difference;

comparing said peak spark voltage to a voltage threshold; and detecting an indicator of an ignition system fault condition based on a comparison between said peak spark voltage and a voltage threshold.

3. The method of claim 2 wherein the computing step includes computing said peak spark voltage as a function of said first time difference and a characteristic signal rise time of a primary ignition coil of said capacitive discharge ignition system.

4. The method of claim 3 wherein the computing step includes computing said peak spark voltage as an average of peak voltage values over a number of engine cycles.

5. The method of claim 2 wherein the detecting step includes incrementing a fault counter if said peak spark voltage exceeds said voltage threshold.

6. The method of claim 5 wherein the determining step further includes concluding existence of said ignition system fault condition if said fault counter exceeds a count threshold.

7. The method of claim 6 wherein the concluding step includes:

computing a ratio of said fault counter and a current number of engine cycles;

providing said count threshold as a percentage threshold; and identifying said ignition system fault condition if said ratio exceeds said percentage threshold.

8. The method of claim 7 wherein said identifying step includes displaying said ignition system fault condition.

9. The method of claim 7 wherein said identifying step includes logging said ignition system fault condition.

10. The method of claim 2 wherein said capacitive discharge system includes an ignition plug, and wherein said ignition system fault condition corresponds to a worn condition of said ignition plug.

11. The method of claim 1 wherein the determining step includes:

computing a peak spark voltage as a function of said first time difference for each of a number of cylinders of said engine;

learning a maximum peak spark voltage for one of said engine cylinders;

calculating an average difference between said maximum peak spark voltage and peak spark voltages of remaining ones of said engine cylinders; and detecting an indicator of an ignition system fault condition based on a comparison between said average difference and a difference threshold.

12. The method of claim 11 wherein the computing step includes computing said peak spark voltage as a function of said first time difference and a characteristic signal rise time of a primary ignition coil of said capacitive discharge ignition system.

13. The method of claim 12 wherein the computing step includes computing said peak spark voltage as an average of peak voltage values over a number of engine cycles.

14. The method of claim 11 wherein the detecting step includes incrementing a fault counter if said difference value exceeds said difference threshold.

15. The method of claim 14 wherein the determining step further includes concluding existence of said ignition system fault condition if said fault counter exceeds a count threshold.

16. The method of claim 15 wherein the concluding step includes:

computing a ratio of said fault counter and a current number of engine cycles;

providing said count threshold as a percentage threshold; and identifying said ignition system fault condition if said ratio exceeds said percentage threshold.

17. The method of claim 16 wherein said identifying step includes displaying said ignition system fault condition.

18. The method of claim 16 wherein said identifying step includes logging said ignition system fault condition.

19. The method of claim 11 wherein said ignition system fault condition corresponds to an external arc fault.

20. The method of claim 1 further including the step of measuring a second time difference between said onset of capacitive discharge and an end of said capacitive discharge;

and wherein the determining step includes determining said at least one ignition fault condition as a function of said second time difference if said first time difference exceeds said second time difference.

21. The method of claim 20 wherein the determining step includes:

comparing said second time difference with a first time threshold; and detecting an indicator of a first ignition system fault condition based on said comparison.

22. The method of claim 21 wherein said capacitive discharge ignition system includes an ignition control module (ICM) responsive to a control signal to implement said onset and said end of said capacitive discharge, and wherein said first ignition system fault condition corresponds to a fault condition associated with said ICM.

23. The method of claim 22 wherein the determining step further includes:

comparing said second time difference with a second time threshold, said second time threshold greater than said first time threshold; and detecting an indicator of a second ignition system fault condition based on said comparison of said second time difference with said first and second time thresholds.

24. The method of claim 23 wherein said capacitive discharge system includes an ignition plug, and wherein said second ignition system fault condition corresponds to an electrically shorted condition of said ignition plug.

25. The method of claim 24 wherein the detecting step includes incrementing a fault counter if said second time difference exceeds said first time threshold but does not exceed said second time threshold.

26. The method of claim 25 wherein the determining step further includes concluding existence of said second ignition system fault condition if said fault counter exceeds a count threshold.

27. The method of claim 26 wherein the concluding step includes:

computing a ratio of said fault counter and a current number of engine cycles;

providing said count threshold as a percentage threshold; and identifying said second ignition system fault condition if said ratio exceeds said percentage threshold.

28. The method of claim 27 wherein said identifying step includes displaying said second ignition system fault condition.

29. The method of claim 27 wherein said identifying step includes logging said second ignition system fault condition.

30. The method of claim 24 wherein the determining step further includes:

comparing said second time difference with a third time threshold, said third time threshold greater than said second time threshold; and detecting an indicator of a third ignition system fault condition based on said comparison of said second time difference with said second and third time thresholds.

31. The method of claim 30 wherein said capacitive discharge system includes an ignition coil, and wherein said third ignition system fault condition corresponds to an electrically shorted condition of said ignition coil.

32. The method of claim 31 wherein the detecting step includes incrementing a fault counter if said second time difference exceeds said second time threshold but does not exceed said third time threshold.

33. The method of claim 32 wherein the determining step further includes concluding existence of said third ignition system fault condition if said fault counter exceeds a count threshold.

34. The method of claim 33 wherein the concluding step includes:

computing a ratio of said fault counter and a current number of engine cycles;

providing said count threshold as a percentage threshold; and identifying said third ignition system fault condition if said ratio exceeds said percentage threshold.

35. The method of claim 34 wherein said identifying step includes displaying said third ignition system fault condition.

36. The method of claim 34 wherein said identifying step includes logging said third ignition system fault condition.

37. The method of claim 31 wherein the determining step further includes detecting an indicator of a fourth ignition system fault condition based on said comparison of said second time difference with said third time threshold.

38. The method of claim 37 wherein said fourth ignition system fault condition corresponds to a worn condition of said ignition plug.

39. The method of claim 38 wherein the detecting step includes incrementing a fault counter if said second time difference exceeds said third time threshold.

40. The method of claim 39 wherein the determining step further includes concluding existence of said fourth ignition system fault condition if said fault counter exceeds a count threshold.

41. The method of claim 40 wherein the concluding step includes:

computing a ratio of said fault counter and a current number of engine cycles;

providing said count threshold as a percentage threshold; and identifying said fourth ignition system fault condition if said ratio exceeds said percentage threshold.

42. The method of claim 41 wherein said identifying step includes displaying said fourth ignition system fault condition.

43. The method of claim 41 wherein said identifying step includes logging said fourth ignition system fault condition.

44. The method of claim 20 wherein the detecting step includes incrementing a fault counter if said second time difference does not exceed said first time threshold.

45. The method of claim 44 wherein the determining step further includes concluding existence of said first ignition system fault condition if said fault counter exceeds a count threshold.

46. The method of claim 45 wherein the concluding step includes:

computing a ratio of said fault counter and a current number of engine cycles;

providing said count threshold as a percentage threshold; and identifying said first ignition system fault condition if said ratio exceeds said percentage threshold.

47. The method of claim 46 wherein said identifying step includes displaying said first ignition system fault condition.

48. The method of claim 46 wherein said identifying step includes logging said first ignition system fault condition.

49. The method of claim 46 wherein said capacitive discharge ignition system includes an ignition control module (ICM) responsive to a control signal to implement said onset and said end of said capacitive discharge, and wherein said first ignition system fault condition corresponds to a fault condition associated with said ICM.

50. The method of claim 46 wherein said capacitive discharge system includes an ignition plug, and wherein said first ignition system fault condition corresponds to an electrically shorted condition of said ignition plug.

51. The method of claim 46 wherein said capacitive discharge system includes an ignition coil, and wherein said first ignition system fault condition corresponds to an electrically shorted condition of said ignition coil.

52. Apparatus for determining component fault conditions as a function of primary coil voltage in a capacitive discharge ignition system, comprising:

an ignition coil including a primary coil electrically connected to a capacitor and a secondary coil electrically connected to an ignition plug;

means for discharging said capacitor through said primary coil;

a spark detection circuit responsive to a primary voltage across said primary coil to compute a first time difference between a beginning of discharge of said capacitor and occurrence of a reflected spark event in said primary voltage; and a processing circuit responsive to said first time difference to determine at least one ignition system fault condition.

53. The apparatus of claim 52 further including a pulse width detection circuit responsive to said primary voltage to compute a second time difference between said beginning of discharge of said capacitor and an end of discharge of said capacitor;

and wherein said processing circuit is further responsive to said second time difference to determine a number of ignition system fault conditions.

* * * * *